US005698382A

United States Patent [19]

Nakahanada et al.

[11] Patent Number: 5,698,382

[45] Date of Patent: Dec. 16, 1997

[54] PROCESSING METHOD FOR SILVER HALIDE COLOR PHOTOGRAPHIC LIGHT-SENSITIVE MATERIAL

[75] Inventors: Manabu Nakahanada; Yutaka Ueda; Hiroaki Kobayashi; Moeko Hagiwara, all of Tokyo, Japan

[73] Assignee: Konica Corporation, Tokyo, Japan

[21] Appl. No.: 716,033

[22] Filed: Sep. 19, 1996

[30] Foreign Application Priority Data

Sep. 25, 1995 [JP] Japan ..... 7-246114
Oct. 20, 1995 [JP] Japan ..... 7-272490

[51] Int. Cl.[6] ..... G03C 7/407

[52] U.S. Cl. ..... 430/418; 430/421; 430/422; 430/423; 430/434; 430/963; 396/604; 396/609

[58] Field of Search ..... 430/418, 421, 430/422, 423, 434, 963; 396/604, 609

[56] References Cited

U.S. PATENT DOCUMENTS 4,233,385 11/1980 Hinz et al. ..... 430/117
4,837,139 6/1989 Kobayashi et al. ..... 430/468
4,948,713 8/1990 Kobayashi et al. ..... 430/434
5,557,362 9/1996 Ueda ..... 354/324

*Primary Examiner*—Hoa Van Le
*Attorney, Agent, or Firm*—Frishauf, Holtz, Goodman, Langer & Chick, P.C.

[57] ABSTRACT

A method for processing a silver halide color photographic light-sensitive material comprising a color developing process is disclosed. The color developing process comprises the first step of supplying one of a first color developing partial solution containing a color developing agent as a principal component and a second color developing partial solution containing an alkaline agent as a principal component, substantially only to an image-forming surface of the light-sensitive material, the second step of supplying one of the first partial solution and the second partial solution other than that supplied at the first step or a color developing solution containing a color developing agent and an alkaline agent, to the image-forming surface of the light-sensitive material at the same time or just after the first step.

10 Claims, 6 Drawing Sheets

PROCESSING METHOD FOR SILVER HALIDE COLOR PHOTOGRAPHIC LIGHT-SENSITIVE MATERIAL

FIELD OF THE INVENTION

The present invention relates to a method for processing a silver halide color photographic light-sensitive material and, more detailed, relates to a method for processing a silver halide color photographic light-sensitive material, by which rapid processing can be carried out with excellent stability like as a dry processing, and the problem of color contamination of the image formed by the process is inhibited.

BACKGROUND OF THE INVENTION

In the field of processing for a silver halide color photographic light-sensitive material, (hereinafter, referred to light-sensitive material, a demand for rapid processing is increasingly strengthen.

On the other hand, reducing in the amount of replenishing is proceeded in a mini-labo for responding to regulation on discharging a waste liquid. Accordingly, the renewal ratio of processing solution is tend to decreasing in mini-lab where a little amount of light-sensitive material is usually processed per day. As a result, problems of formation of precipitation and tar, and difficulty of maintaining stable processing properties are tend to raise because a color developer, particular a color developer for rapid processing having a high concentration, is easily sustained oxidation by air. As a measure to such the problems, JP O.P.I. 6-324455/1994 describes a processing method in which a color developer is enclosed in a sealed container to prevent air oxidation and is sprayed to a light-sensitive material to be processed. However, this technique cannot be applied for practical use, since any sufficient developing property cannot be obtained by the method.

Recently, accompanied by suddenly increasing of mini-lab shops, a need for a processing system is raised, which does not cause formation of waste liquid and is easily used by an inexperienced person in operation, of apparatus with feeling that no processing solution is used as like as in a dry processing. Further, a system is also required, by which processing can be stably carried out when the system is installed in any environment such as a room in which the room temperature is largely fluctuated.

Until now, it is tried to stably maintain the composition of a developer by directly supplying the developer onto the image-forming surface or the emulsion surface of a light-sensitive material. However, in the known method, relatively large amount of developer is supplied onto the emulsion surface. In such the case, it is found that the supplied developer is not wholly permeated into the light-sensitive material and is flowed down from the surface of the light-sensitive material. As a result, the excessive processing solution overflowed around the transporting course of light-sensitive material causes precipitation of crystals which give bad influence on the following light-sensitive material to be processed. Accordingly, it is necessary to set the amount of the processing solution so small as to prevent the flowing down of processing solution, for stably carrying out the processing with feeling of dry processing.

However, an usual color developing solution cannot be used because which is considerably shot for the amount of the color developing agent contained therein to complete the developing reaction when such the processing solution is used in a small supplying amount as above-mentioned. It is necessary to increase the concentration of color developing agent for supplying a sufficient amount of color developing agent necessary for developing reaction. However, it is impossible to increase the concentration of color developing agent in the usual color developer system, since the solubility of the color developing agent is low in the color developer and the problem of the crystal precipitation is raised.

JP No. 2-203338/1990 describes that the processing rate is made higher by a method in which the developing solution is divided to two partial solutions for making, i.e., a solution containing a color developing agent and having a lower pH value and a solution containing an alkaline agent and having a higher pH value, and the permeation of the solutions is accelerated by immersing a light-sensitive material in the solutions in due order or coating the solutions onto a light-sensitive material by a roller. However, the problem of color contamination in the image formed by the processing is caused when the solution containing a high concentration of color developing agent is provided to a light-sensitive material by such the method since an excessive amount of the color developing agent is existed in the light-sensitive material.

Further, the permeability of processing solution is low in an usual silver halide photographic light-sensitive material since the light-sensitive material is hardened in advance to the supplying of the processing solution. Accordingly, the processing speed, particularly the developing speed, is lowered accompanied with the hardening of the layer of the light-sensitive material. Particularly in the case of color development, the developing reaction speed is further inhibited when the amount of the processing solution is small because the concentration of halide ions is raised by dissolving out of halide ions from the silver halide accompanied with the progression of silver development. The above-mentioned problem is serious in an ordinary silver halide photographic light-sensitive material, even though the halide ion concentration is not become an actual problem in the case of the above-mentioned JP O.P.I. No. 6-324,455/1994 since the technique disclosed in this document related to a redox amplifying process, the kind of the light-sensitive material to be applied is limited and the amount of silver is small.

Further, any means for accelerating the reaction of the processing solution is not described in JP O.P.I. No. 6-324455. Therefore, a considerable time is necessary to the color developing process when the technique disclosed in this document is applied on the processing for an ordinary silver halide photographic light-sensitive material. Accordingly, the present demand of the market cannot be satisfied by this technique.

SUMMARY OF THE INVENTION

This invention has been made based on the above-mentioned background. The first object of the invention is to provide a method for processing a silver halide photographic light-sensitive material by which a processing can be carried out rapidly and stably without a problem of color contamination in the formed image when the supplying amount of the developer is made small so as the processing can be performed with feeling of dry processing without formation of liquid flowing marks. The second object of the invention is to provide a method for processing a silver halide photographic light-sensitive material by which a processing can be carried out rapidly and stably with less development uneveness even when the processing amount is small in any environment.

The above object of the invention can be attained by a method for processing a silver halide color photographic light-sensitive material comprising a color developing process which comprises the first step of supplying one of a first color developing partial solution containing a color developing agent as a principal component and a second color developing partial solution containing an alkaline agent as a principal component, substantially only to an image-forming surface of a light-sensitive material, the second step of supplying one of the first partial solution, and the second partial solution other than that supplied at the first step or a color developing solution containing a color developing agent and an alkaline agent, to the image-forming surface of the light-sensitive material at the same time or just after the first step.

In embodiments of the invention it is preferred that the first partial solution contains a developing agent in an amount of 0.005 to 1.00 moles per liter, the second partial solution contains an alkaline agent in an amount of 0.1 to 3.5 moles per liter and the time that the light sensitive material is passed through the color developing process is 5 to 45 seconds.

DETAILED DESCRIPTION OF THE INVENTION

Figure 1:
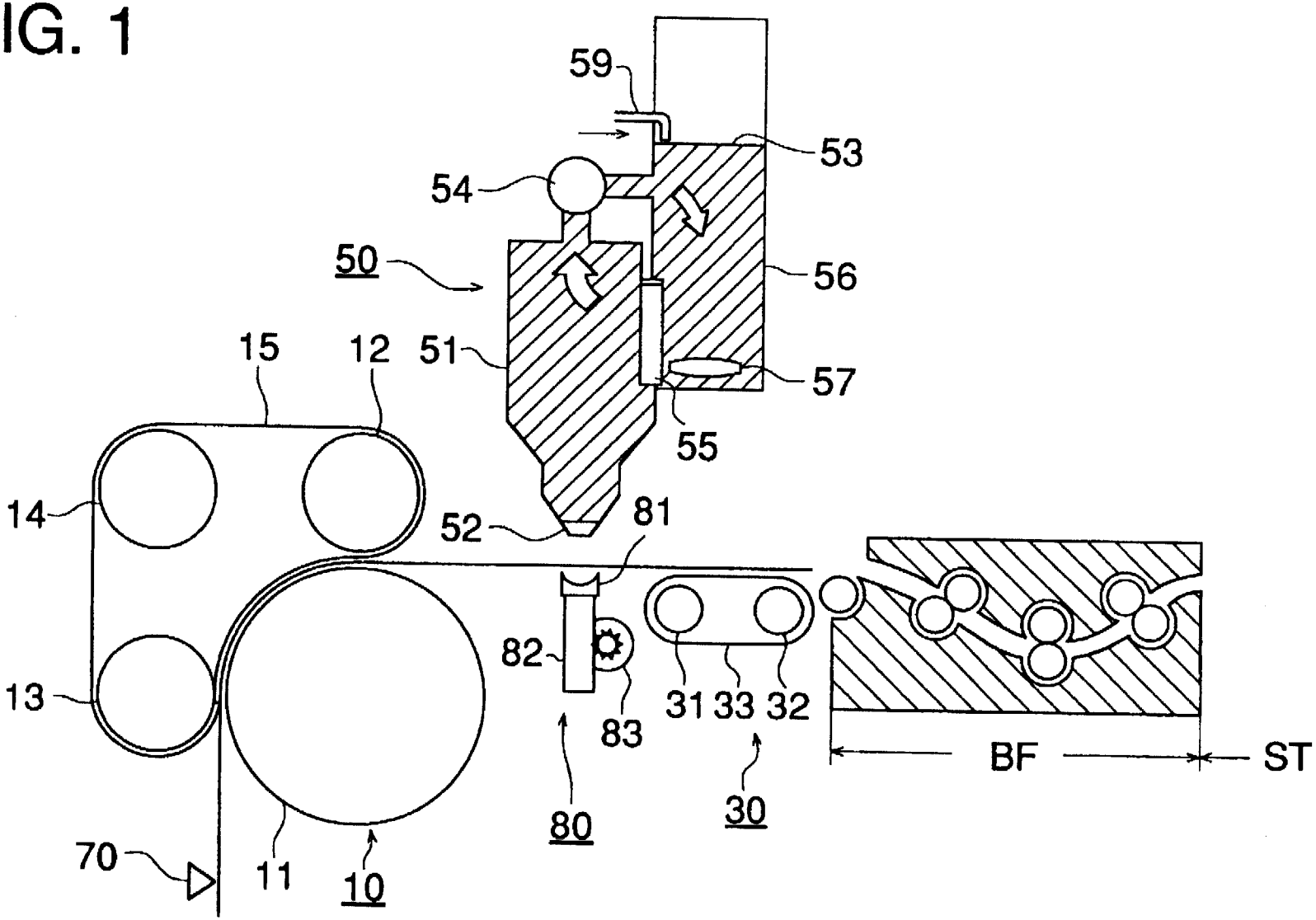
FIG. 1 is a schematic drawing of the principal part of an automatic processor

The inventors have noted that the concentration of a developing agent can be made to considerably higher by raising the solubility of the developing agent by separating a color developing solution to a partial solution containing the color developing agent and another partial solution containing an alkaline agent and setting the pH value of the former at a low value, and have found that consumption of the developing agent in an upper layer of the light-sensitive material can inhibited and the development in the lower layer can accelerated when both of the partial solution highly concentrated are simultaneously supplied to the image-forming surface of the light-sensitive material. In such the case, the two partial solutions are mixed while permeating through the layers of the light-sensitive material and the developing reaction is occurred. The inventors have found further advantages that a prescribed amount of each of the processing solutions can be exactly supplied to each image unit and storage ability of the solutions can be guaranteed because the solutions each can be enclosed in a sealed container when the solutions are supplied to the light-sensitive material through space substantially at the same time or just after the supplying one of the solution.

Although a method in which an oxidation agent solution is sprayed to a light-sensitive material after development thereof is described in U.S. Pat. No. 5,121,131, this description does not suggest the concept of the color development of the invention.

The invention is described as to the each item below.

[Silver halide photographic light-sensitive material]

As examples of light-sensitive material to be processed by the processing method of the invention, a silver halide color photographic light-sensitive material containing a silver chloride emulsion and that containing a silver iodobromide emulsion or a silver bromide emulsion are described. In the invention a silver halide color light-sensitive material containing silver chloride is preferable.

[Supplying of processing solution]

One of the essential constitution of the invention is to supply at least one of the first partial solution containing a color developing agent as a principal component and the second partial solution containing an alkaline agent as a principal component substantially only to the image-forming surface at the first step of the processing. Accordingly, the first supplying step does not include an embodiment in which the light-sensitive material is completely immersed in a processing solution such as practiced in an ordinary processing in an automatic processor. The supplying form at the first step includes, for example, is that by scattering the solution to the image-forming surface of the light-sensitive material, that by coating the solution on the image-forming surface of the light-sensitive material with a curtain coater of a sponge. The preferable supplying form at the first step is the supplying through space.

As concrete means for supplying a processing solution through space, a solution scattering means for scattering the processing solution through space and a solution coating means for coating the processing solution through space are described. As the processing solution scattering means which scatters the processing solution through the space, one having a mechanism similar to the ink-jet head of a ink-jet printer, one which actively scatters the processing solution through the space by pressure generated in the processing scattering means such as that described in JP O.P.I. No. 6-324455/1994, and one which scatters the processing solution through the space by pressure applied to the solution are described. As the processing solution scattering means for scattering the solution through the space having a structure similar to that of the ink-jet head of an ink-jet printer, one supplying the processing solution by vibration and one supplying the processing solution by bumping are cited. One having a structure similar to that of the ink-jet head of an ink-jet printer is preferred since the supplying amount of the processing solution can be easily controlled and processing position of the light-sensitive material can be selected.

As the form of means for supplying processing solution through space, any of one supplying the processing solution from a linear-shaped supplying head to the light-sensitive material through the space, one supplying the processing solution from a plane- shaped supplying head to the light-sensitive material through the space, one supplying the processing solution from a point-shaped supplying head to the light-sensitive material through the space, and another method can be used. When the light-sensitive material is a sheet, it is allowed that the processing solution may be supplied through the space from a plate-shaped supplying head having a size corresponding to the size of the light-sensitive material under a condition that the positional relation between the supplying head and the light-sensitive material is fixed. However, it is more preferred that the processing solution is supplied through the space while shifting the positional relation between the supplying head and the light-sensitive material, since the processing solution can be sufficiently supplied even if the size of the head is small. When the linear-shaped supplying head is used, although the supplying head may be moved, it is preferred to move the light-sensitive material in a direction not parallel with the line-direction of linear-shaped supplying head for rapidly supplying the processing solution to the light-sensitive material. It is particularly preferred to move the light-sensitive material in the direction making a right angle to the line of the linear-shaped head for maintaining the processing for a designated time.

In the present invention, the "supplying amount" means the amount of the processing solution directly supplied on the surface of emulsion layer when the processing solution is supplied through the space, and the replenished amount of the replenishing solution when the processing solution is supplied to the light-sensitive material by immersion. It is preferred that at least the partial solution containing the color developing agent as a principal component is directly supplied through space to the emulsion surface of the light-sensitive material.

The amount of the partial solution supplied through the space may be changed according to the supplying position thereof. Although at least one of the partial solution containing the developing agent as a principal component and the partial solution containing the alkaline agent as a principal component is preferably supplied through the space, it is preferred that both of these solutions are supplied through the space.

Although for the second supplying step, for example, an ordinary method for supplying in which the light-sensitive material is completely immersed in the processing solution, may be used, the supplying method the same as at the first supplying step is preferably used.

[Heating means]

It is preferred in the invention to heat the light-sensitive material with a heating means at a temperature of not lower than 40° C., more preferably not lower than 45° C., particularly preferably not lower than 50° C., although the temperature may be less than 40° C. The temperature is preferably not higher than 150° C. from the viewpoint of heat resistivity of the light-sensitive material and easily controlling the processing condition, and is more preferably 100° C., particularly not higher than 90° C., to prevent boiling of the processing solution.

As the means for heating the light-sensitive material, a conduction heating means such as heating drum or heating belt which is contacted with the light-sensitive material and heats it by heat conduction, a convection heating means such as a dryer which heats the light-sensitive material by convection current of air, and a irradiation heating means which heats the light-sensitive material by irradiation such as infrared-lay or high-frequency electromagnetic ray.

It is preferred to have a heating controlling means for controlling the heating means so as to operate the heating means when the light-sensitive material exists at the position where the light-sensitive material to be heated. Such the condition can be attained by using a device having a transporting means for transporting the light-sensitive material with a prescribed speed and a light-sensitive material detecting means for detecting the presence of the light-sensitive material at a designated position being upper current side of the position where the light-sensitive material to be heated, and controlling the heating means by detection signal generated from the detecting means. In such the controlling, it is preferred to control the heating means so that the heating means is operated to heat with a designated condition between from the time later by prescribed duration from the time when the detective means detects entering the light-sensitive material in the above designated position, to the time later by prescribed duration from the time when the detective means detects leaving off the light-sensitive material from the above designated position.

Although the light-sensitive material is preferably heated at the time of before the color developing process, during the color developing process, or after the color developing process, it is more preferable that the light-sensitive material is heated at least before the color developing process.

[Color developing process]

In the present invention, the first color developing partial solution containing a color developing agent as a principal component is a solution which contains a color developing agent in an amount of not less 50% by weight and has a pH value of 0 to 4, preferably 1 to 2.5. The second color developing partial solution containing an alkaline agent as a principal component is a solution which contains an alkaline agent in an amount of not less than 50% by weight and has a pH value of 9 to 14, preferably 10 to 13. The color developing solution is a solution which contains a color developing agent and an alkaline agent and has a pH value of 8 to 14. The color developing solution is different from the second partial solution on the point that the color developing solution contains a color developing agent together with an alkaline agent. Various kinds of additive such as a surfactant, a solubilizing agent for color developing agent, a preservant and pH controlling agent may be properly added to any of the first color developing partial solution, the second color developing partial solution and the color developing solution.

The color developing process in the invention means the period from the time of supplying the first partial solution to, for example, the front end of the light-sensitive material to the time of supplying a processing solution of the next processing step (such as a bleach-fixing solution, bleaching solution or stopping solution) to the front end of the light-sensitive material, or to the time of immersion of the front end of the light-sensitive material into a processing solution of the next processing step. The time for passing the light-sensitive material through the color developing process is usually 5 to 45 seconds, preferably 5 to 20 seconds., which is the time between supplying the first partial solution of color developer to, for example, the front end of the light-sensitive material and supplying a processing solution of the next processing step to the front end of the light-sensitive material.

The ratio of the first partial solution containing the color developing agent as a principal component and the second partial solution containing the alkaline agent as a principal component is preferably within the range of 0.1 to 10, more preferably 0.2 to 5, further preferably 0.5 to 2. The supplying amount of each of the solutions is usually 5 to 150 ml, preferably 10 to 100 ml, more preferably 10 to 50 ml per square meter of the light-sensitive material. The total amount of the solutions is usually 10 to 300 ml, preferably 10 to 100 ml, more preferably 20 to 60 ml per square meter of the light-sensitive material.

In the invention, "supplying at the same time or just after" means the interval of the first solution supplying step and the second solution supplying step is within the range of 0 to 5 seconds, preferably 0 to 3 saeconds, more preferably 0 to 1 second, further preferably 0 to 0.3 seconds.

The time for supplying all the processing solutions for color development to the emulsion surface or image-forming surface of the light-sensitive material is within ½, preferably within ⅓, more preferably 1/10, of the earlier period of passing the light-sensitive material through the color developing process.

It is preferred that the processing solutions each supplied at each of the supplying steps for color development are supplied in proportion to the exposure amount given to the light-sensitive material, but it is not always necessarily to do so. A step may further be provided for supplying water to the image-forming surface of the light-sensitive material in advance of the first step for supplying the one of the processing solution for color development. Preferable examples of the order of supplying of the processing solutions for color development are as follows:

(1) Partial solution containing a color developing agent as a principal component→Partial solution containing an alkaline agent as a principal component
(2) Partial solution containing a color developing agent as a principal component→Color developing solution
(3) Water→Partial solution containing a color developing agent as a principal component→Partial solution containing an alkaline agent as a principal component
(4) Water→Partial solution containing a color developing agent as a principal component→Color developing solution
(5) Partial solution containing an alkaline agent as a principal component→Partial solution containing a color developing agent as a principal component
(6) Water→Partial solution containing an alkaline agent as a principal component→Partial solution containing a color developing agent as a principal component Among the above, preferable examples are (1), (2), (3) and (4), further preferable examples are (1) and (3).

The color developing agent is preferably a p-phenylene diamine compound having a water solubilizing group. The above-described p-phenylenediamine compound has at least one water solubilizing group on its amino group or benzene ring. As the concrete water solubilizing group, the followings are described: $-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$, in which m and n independently an integer of not less than 0, —COOH and $-SO_3H$.

Exemplified compounds of the p-phenylenediamine compounds preferably used in the present invention include the following compounds (C-1) through (C-18).

(Exemplified compounds)

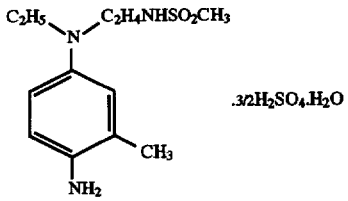

(C-1)

-continued

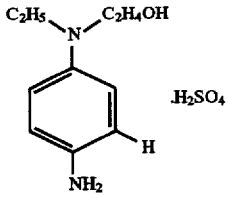

(C-2)

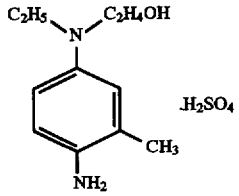

(C-3)

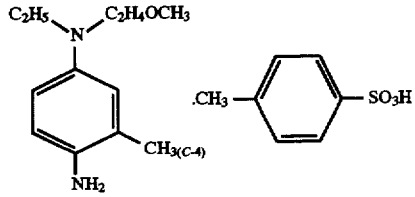

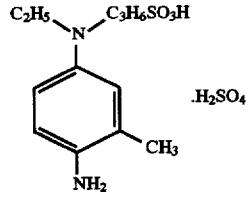

(C-5)

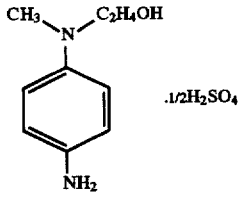

(C-6)

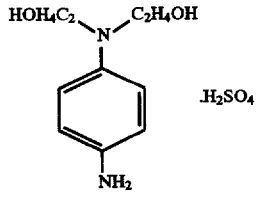

(C-7)

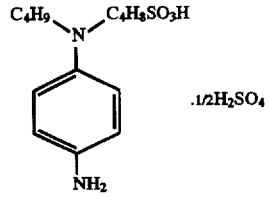

(C-8)

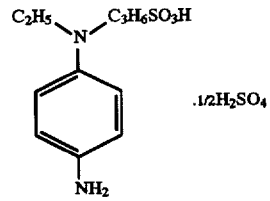

(C-9)

-continued

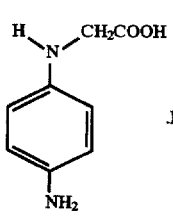

(C-10)

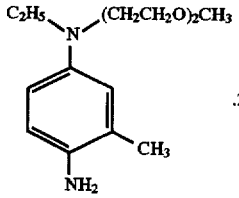

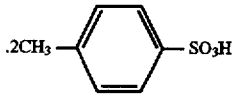

(C-11)

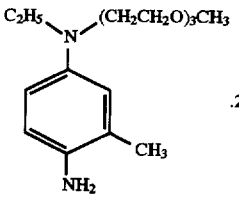

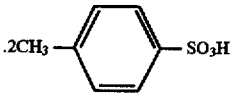

(C-12)

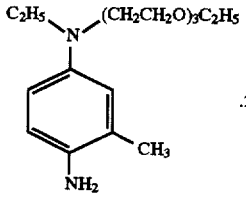

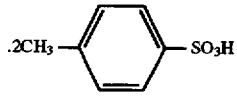

(C-13)

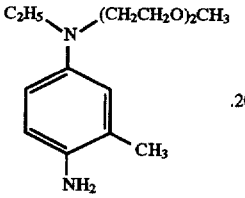

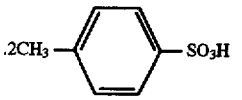

(C-14)

(C-15)

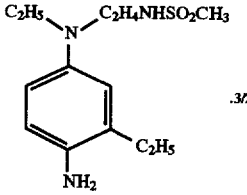

(C-16)

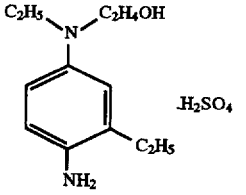

-continued

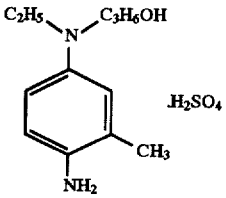

(C-17)

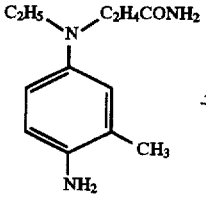

(C-18)

Of the above exemplified p-phenylenediamine compounds, Exemplified compounds (C-1), (C-2), (C-3), (C-4), (C-15), (C-17), and (C-18) are preferable.

The color developing agent preferably usable other than the above is a p-phenylene diamine compound having a water solubilizing group represented by the following Formula P.

Formula P

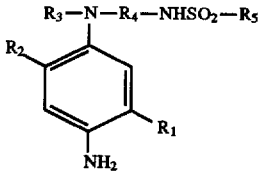

In Formula P, $R_1$ and $R_2$ are each a hydrogen atom, a halogen atom, an alkyl group, an alkoxyl group or an acylamino group. $R_3$ is an alkyl group, $R_4$ is an alkylene group. $R_5$ is a alkyl group or an aryl group, the alkyl group and aryl group each may have a substituent.

The examples of the compound include the following compounds (C-19) through (C-35). The examples are given below by showing concretely the groups of $R_1$ through $R_5$.

| | $R_1$ | $R_2$ | $R_3$ | $R_4$ | $R_5$ |
|---|---|---|---|---|---|
| C-19 | —H | —H | $—C_3H_7$ | $—CH_2CH(—CH_3)—$ | $—CH_3$ |
| C-20 | $—NHCOCH_3$ | —H | $—CH_3$ | $—CH_2CH_2—$ | $—CH_3$ |
| C-21 | —H | —H | $—CH_3$ | $—CH_2CH(—CH_3)—$ | $—CH_3$ |
| C-22 | $—CH_2CH_3$ | —H | $—CH_3$ | $—CH_2CH_2—$ | $—CH_3$ |
| C-23 | $—CH_3$ | —H | $—CH_3$ | $—CH_2CH(—CH_3)—$ | $—CH_2CH_3$ |
| C-24 | $—CH_3$ | —H | $—CH_3$ | $—CH_2CH_2—$ | $—CH_2CH_3$ |
| C-25 | $—O—CH_2CH_3$ | —H | $—CH_2CH_3$ | $—CH(—CH_3)CH_2—$ | $—CH_3$ |
| C-26 | $—NHCOCH_3$ | —H | $—C_3H_7$ | $—CH_2CH_2—$ | $—CH_3$ |
| C-27 | $—CH_3$ | —H | $—CH_2CH_3$ | $—CH_2CH_2—$ | $—CH_2—O—CH_3$ |
| C-28 | —H | —H | $—CH_3$ | $—CH_2CH_2—$ | $—CH_2—N—(CH_3)_2$ |
| C-29 | $—CH_3$ | —H | $—CH_2CH_3$ | $—CH_2CH_2—$ | $—CH_2Cl$ |
| C-30 | $—CH_3$ | —H | $—CH_2CH_3$ | $—CH_2CH_2—$ | $—CH_2—NHCO—CH_3$ |
| C-31 | $—CH_2CH_3$ | —H | $—CH_2CH_3$ | $—CH_2CH_2—$ | $—CH_2—O—CH_3$ |
| C-32 | $—CH_3$ | —H | $—CH_2CH_3$ | $—CH_2CH_2—$ | $—CH_2—O—CH_2CH_3$ |
| C-33 | $—CH_3$ | —H | $—CH_2CH_3$ | $—CH_2CH_2CH_2—$ | $—CH_3$ |
| C-34 | —Cl | —H | $—CH_3$ | $—CH_2CH_2CH_2—$ | $—CH_3$ |
| C-35 | $—O—CH_3$ | —H | $—CH_2CH_3$ | $—CH_2CH(—CH_3)—$ | $—CH_3$ |

Of these exemplified compounds, the preferable are (C-20), (C-27), (C-28), (C-29), (C-30) and (C-33), and the most preferable is (C-1). The synthetic method of the compounds of the invention represented by Formula P can be performed with reference to the synthesis procedures described in JP O.P.I. No. 4-37198/1992. These color developing agents are usually used in a form of a salt such as a hydrochloride, sulfate or p-toluenesulfonate.

The above-mentioned color developing agents may be used singly or in combination of two kinds or more and may optionally be used together with black-and-white developing agents such as phenidone, 4-hydroxymethyl-4-methyl-1-phenyl-3-pyrazolidone and metol.

It is preferred that the processing solution for color development contains a compound represented by Formula [H] or [B] since such the developer is stable in the photographic properties and less fog in the unexposed area.

Formula [H]

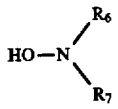

In Formula [H], $R_6$ and $R_7$ are each independently a hydrogen atom, an alkyl group, an aryl group or R'CO—, provided that $R_1$ and $R_2$ are not simultaneously hydrogen atoms and the alkyl group represented by $R_6$ or $R_7$ may be the same or the different. $R_6$ and $R_7$ are preferably an alkyl group having 1 to 3 carbon atoms, which may have a carboxyl group, a phosphoric acid group, a sulfonic acid group or a hydroxyl group. R' is an alkoxy group, an alkyl group or an aryl group. The alkyl and aryl group represented by $R_6$, $R_7$ or R' each may have a substituent and $R_6$ and $R_7$ may combine to form a ring, for example, a heterocyclic ring such as piperidine, pyridine, triazine or morpholine.

Formula B

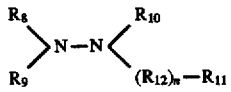

In Formula B, $R_9$, $R_9$ and $R_{10}$ are each independently a hydrogen atom, an alkyl, an aryl or a heterocyclic group, the alkyl, aryl and heterocyclic group may have a substituent; $R_{11}$ is a hydroxyl group, a hydroxyamino group, an alkyl group, an aryl group, a heterocyclic group, an alkoxy group, an aryloxy group, a carbamoyl or amino group, the alkyl group, aryl group, heterocyclic group, alkoxy group, aryloxy group, carbamoyl and amino group each may have a substituent. The heterocyclic groups have each a 5- or 6-member ring which is constituted by C, H, O, N, S or halogen atom and may also be saturated or unsaturated. $R_{12}$ is a divalent group selected from the group consisting of —CO, $—SO_2—$ and —C(=NH)—; and n is an integer of 0 or 1, provided that, when n=0, $R_{11}$ represents a group selected from the group consisting of alkyl groups, aryl groups and heterocyclic groups and that $R_{10}$ and $R_{11}$ may also be associated to form a heterocyclic ring.

Among the compounds represented by Formula H, those represented by Formula D are particularly preferable.

Formula D

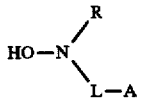

In Formula D, L is an alkylene group; A is a carboxyl group, a sulfo group, a phosphono group, a phosphinic acid group, a hydroxyl group, an amino group, an ammonio group, a carbamoyl group or a sulfamoyl group; and R is a hydrogen atom or an alkyl group; L, A and R each include ones each having a straight-chain and ones having a branched-chain, and they may be unsubstituted or substituted. L and R may be linked to form a ring.

The compound represented by Formula D is detailed below.

L is a straight-chain or branched-chain alkylene group having 1 to 10 carbon atoms which may have a substituent, among them, those having 1 to 5 carbon atoms are preferred. To be more concrete, the preferable examples thereof include a methylene group, an ethylene group, a trimethylene group and a propylene group. The substituent thereof include, for example, a carboxyl group, a sulfo group, a phosphono group, a phosphinic acid residual group, a hydroxyl group, an alkyl-substitutable ammonio group and, among them, the preferable examples thereof include a carboxyl group, a sulfo group, a phosphono group and a hydroxyl group. A is a carboxyl group, a sulfo group, a phosphono group, a phosphinic acid residual group, a hydroxyl group, an alkyl-substitutable amino group, an alkyl-substitutable ammonio group, an alkyl-substitutable carbamoyl group or an alkyl-substitutable sulfamoyl group and, among them, the preferable examples thereof include a carboxyl group, a sulfo group, a hydroxyl group, a phosphono group and an alkyl-substitutable carbamoyl group. The examples of -L-A include, preferably, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a carboxymethyl group, a carboxyethyl group, a sulfoethyl group, a sulfopropyl group, a phosphonomethyl group and a phosphonoethyl group. R is a hydrogen atom, a straight-chain or the branched-chain alkyl group having 1 to 10 carbon atoms which may have a substituent, among them, those having 1 to 5 carbon atoms are preferred. The substituents thereof include, for example, a carboxyl group, a sulfo group, a phosphono group, a sulfinic acid residual group, a hydroxyl group, an alkyl-substitutable amino group, an alkyl-substitutable ammonio group, an alkyl-substitutable carbamoyl group, an alkyl-substitutable sulfamoyl group, provided that there may be two or more substituents. The preferable examples thereof represented by R include a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a hydrogen atom, a carboxymethyl group, a carboxyethyl group, a sulfoethyl group, a sulfopropyl group, a phosphonomethyl group and a phosphonoethyl group. L and R may be coupled to each other so as to form a ring.

Next, among the compounds represented by Formula [D], some typical examples thereof will be given below. However, the invention shall not be limited to the compounds given below.

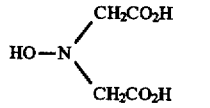
(D-1)

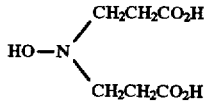
(D-2)

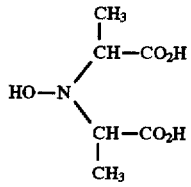
(D-3)

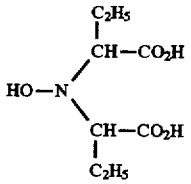
(D-4)

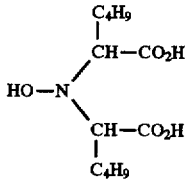
(D-5)

-continued

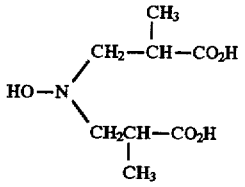
(D-6)

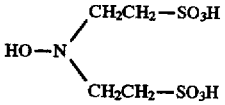
(D-7)

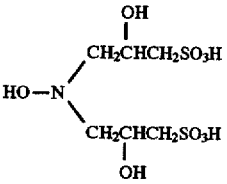
(D-8)

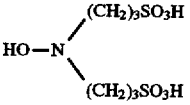
(D-9)

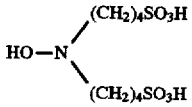
(D-10)

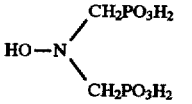
(D-11)

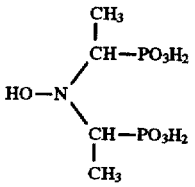
(D-12)

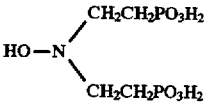
(D-13)

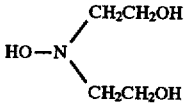
(D-14)

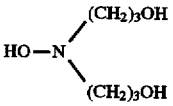
(D-15)

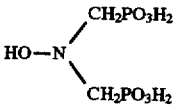
(D-16)

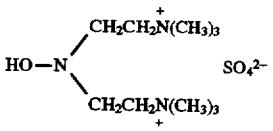
(D-17)

-continued

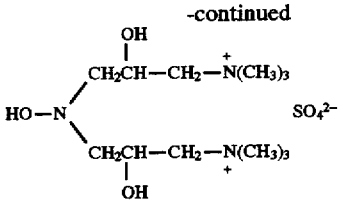
(D-18)

$HO-NH-CH_2CO_2H$ (D-19)

$HO-NH-CH_2CH_2CO_2H$ (D-20)

$HO-NH-CH(CH_3)-CO_2H$ (D-21)

$HO-NH-CH(C_2H_5)-CO_2H$ (D-22)

$HO-NH-CH(C_4H_9)-CO_2H$ (D-23)

$HO-NH-CH(CH_3)-CH_2-CO_2H$ (D-24)

$HO-NH-CH_2-CH(CH_3)-CO_2H$ (D-25)

$HO-NH-CH_2CH_2SO_3H$ (D-26)

$HO-NH-CH_2CH(OH)CH_2SO_3H$ (D-27)

$HO-NH-(CH_2)_3SO_3H$ (D-28)

$HO-NH-(CH_2)_4SO_3H$ (D-29)

$HO-NH-CH_2PO_3H_2$ (D-30)

$HO-NH-CH(CH_3)-PO_3H_2$ (D-31)

$HO-NH-CH_2CH_2PO_3H_2$ (D-32)

$HO-NH-CH_2CH_2OH$ (D-33)

$HO-NH-(CH_2)_3OH$ (D-34)

$HO-NH-CH_2-PO_3H_2$ (D-35)

$HO-NH-CH_2CH_2\overset{+}{N}(CH_3)_3$ (D-36)

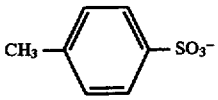

$HO-NH-CH_2CH(OH)CH_2\overset{+}{N}(CH_3)_3$ (D-37)

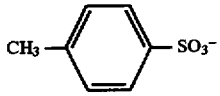

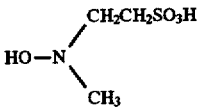
(D-38)

-continued

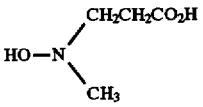
(D-39)

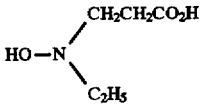
(D-40)

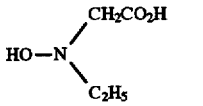
(D-41)

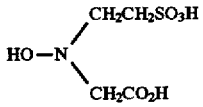
(D-42)

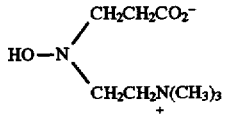
(D-43)

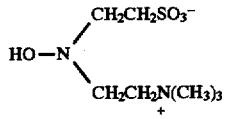
(D-44)

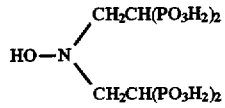
(D-45)

$HONHCH_2CH(PO_3H_2)_2$ (D-46)

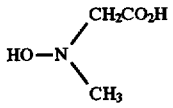
(D-47)

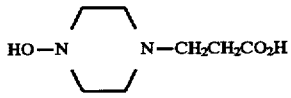
(D-48)

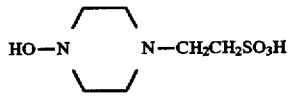
(D-49)

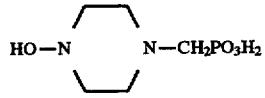
(D-50)

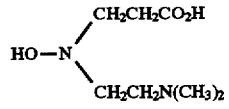
(D-51)

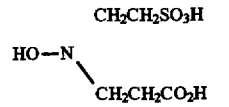
(D-52)

-continued

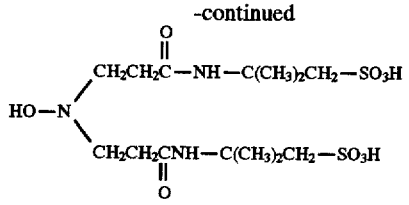

(D-53)

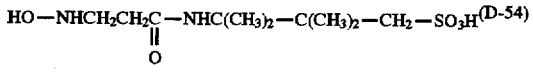

(D-54)

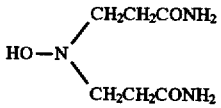

(D-55)

The compounds represented by Formula [H] or [B] are usually used in the form of a free amine, a hydrochloride, a sulfate, a p-toluene sulfonate, an oxalate, a phosphate or an acetate.

In each of the processing solutions for color development used in the invention, a sulfite salt can be used as a preservative, and further a buffering agent can be used. Such the sulfite salt includes sodium sulfite, potassium sulfite, sodium bisulfite and potassium bisulfite. It is preferred that the sulfite is contained in the partial solution containing the color developing agent as a principal component and the color developing solution, but it may be not so. The concentration of the sulfite is preferably $1\times10^{-4}$ to $5\times10^{-2}$ moles per liter.

Each of the processing solutions for color development in the invention may contains a buffering agent. Examples of preferable buffering agents include potassium carbonate, sodium carbonate, sodium bicarbonate, potassium bicarbonate, trisodium phosphate, dipotassium phosphate, sodium borate, potassium borate, sodium tetraborate or boric acid, potassium tetraborate, sodium o-hydroxybenzoate or sodium salicylate, potassium o-hydroxybenzoate, sodium 5-sulfo-2-hydroxybenzoate or sodium 5-sulfosalicylate and potassium 5-sulfo-2-hydroxybenzoate or potassium 5-sulfosalicylate.

Examples of the alkaline agent usable in the partial solution containing an alkali agent as a principal component or color developing solution usable in the invention include lithium hydroxide, sodium hydroxide, potassium hydroxide and the above-mentioned buffering agents. The cincentration of the alkaline agent in the partial solution containing an alkaline agent as a principal component is usually 0.1 to 3.5 moles per liter, preferably 0.3 to 1.2 moles per liter. The concentration of the alkaline agent in the color developing solution is usually 0.1 to 0.5 moles per liter, preferably 0.15 to 0.3 moles per liter. When the alkaline agent is difficulty dissolved depending to the influence of the temperature or another solute, it is preferred to use the alkaline agent in an amount of within the range of dissolvable. Although the alkaline agent may be used in the partial processing solution containing a developing agent as a pricipal component, it is preferred that the amount of the alkaline agent is so small necessary to controll the pH value of the solution.

Each of the processing solutions for color development of the invention may contain a development accelerator. As the accelerator, thioether type compounds, p-phenylenediamine type compounds, quaternary ammonium salts, p-aminophenols type, amine compounds, polyalkylene oxides, 1-phenyl-3-pyrazolidones, hydrazines, mesoionic type compounds and imidazoles may be cited. They may be so added as to meet the requirements.

It is preferable that each of the processing solution for color development does not substantially contain benzyl alcohol.

For the purposes of inhibiting fog formation, chlorine ion and bromine ion may also be added to each of the processing solutions for color development of the invention. When these ions are added directly into a color developer, for example, sodium chloride, potassium chloride, ammonium chloride, nickel chloride, magnesium chloride, manganese chloride and calcium chloride are usable as the chlorine ion supplying substances. Among these, sodium chloride and potassium chloride are preferred. The bromine ion supplying substances include sodium bromide, potassium bromide, ammonium bromide, lithium bromide, calcium bromide, magnesium bromide, manganese bromide, nickel bromide, cerium bromide and thallium bromide. Among these materials, potassium bromide and sodium bromide are preferred. The content of the halide ion is 0.02 moles per liter at the most, and preferably not more than 0.001 moles per liter. It is most preferable that the halogen ion is substantially not contained.

It is preferable that each of the processing solutions for color development of the invention contains a triazinyl stilbene type fluorescent whitening agent. As the fluorescent whitening agent, a compound represented by the following Formula E is preferred.

Formula E

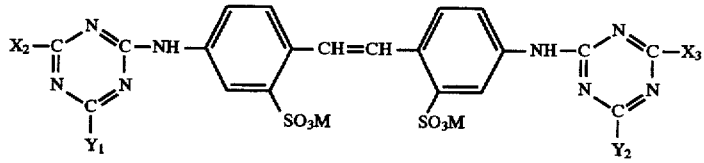

In the above, $X_2$, $X_3$, $Y_1$ and $Y_2$ independently represent a hydroxyl group or a halogen atom such as chlorine or bromine, an alkyl group, an aryl group,

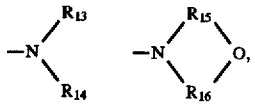

or $—OR_{17}$, in which $R_{13}$ and $R_{14}$ are each independently a hydrogen atom, an alkyl group including substituted one thereof or an aryl group including submitted one thereof, $R_{15}$ and $R_{16}$ are each independently an alkylene group including substituted one thereof, $R_{17}$ represents a hydrogen atom, an alkyl group including substituted one thereof or an aryl group including substituted one thereof, and M represents a cation.

Further, various kinds of addenda such as a stain preventing agent, a sludge preventing agent and an interlayer effect accelerating agent.

Each of the processing solution for color development of the invention preferably contains a chelating agent represented by the following Formula K-I to K-IV or K-V.

Formula K-I

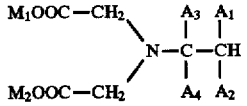

wherein $A_1$, $A_2$, $A_3$ and $A_4$ are each independently, they may be the same or different, a hydrogen atom, a hydroxyl group, —COOM, —$PO_3(M_1)_2$, —$CH_2COOM_2$, —$CH_2OH$ or a lower alkyl group, provided that at least one of $A_1$, $A_2$, $A_3$ and $A_4$ is —COOM, —$PO_3(M_1)_2$ or —$CH_2COOM_2$. M, $M_1$ and $M_2$ are each a hydrogen atom, an ammonium group, an alkali metal atom or an organic ammonium group.

Formula K-II

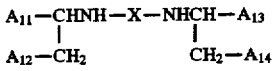

wherein $A_{11}$, $A_{12}$, $A_{13}$ and $A_{14}$ are each independently, they may be the same or different, —$CH_2OH$, —$COOM_3$ or —$PO_3(M_4)_2$, $M_3$ and $M_4$ are each a hydrogen atom, an ammonium group, an alkali metal atom or an organic ammonium group. X is an alkylene group having 2 to 6 carbon atoms or —$(B_1O)_n$—$B_2$—, in which n is an integer of 1 to 8, and $B_1$ and $B_2$ are each an alkylene group having 1 to 5 carbon atoms, they may be the same or different.

Formula K-III

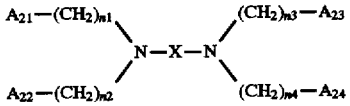

wherein $A_{21}$, $A_{22}$, $A_{23}$ and $A_{24}$ are each independently, they may be the same or different, —$CH_2OH$, —$COOM_5$ or —$PO_3(M_6)_2$, $M_5$ and $M_6$ are each a hydrogen atom, an ammonium group, an alkali metal atom or an organic ammonium group. $X_1$ is a straight-chain or branched-chain alkylene group having 2 to 6 carbon atoms, a saturated or unsaturated organic group forming a ring or —$(B_{11}O)_{n5}$—$B_{12}$—, in which $n_5$ is an integer of 1 to 8, and $B_{11}$ and $B_{12}$ are each an alkylene group having 1 to 5 carbon atoms, $n_1$ through $n_4$ are each an integer of 1 or more. they may be the same or different.

Formula K-IV

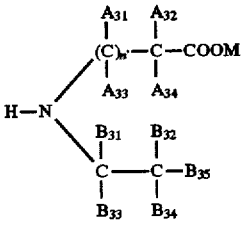

wherein M is a hydrogen atom, a cation or an alkali metal atom; $A_{31}$ through $A_{34}$, and $B_{31}$ through $B_{35}$ are each —H, —OH, —$C_nH_{2n+1}$ or —$(CH_2)_mX_2$; n and m are each integer of 1 to 3 and 0 to 3, respectively; $X_2$ is —$COOM_7$ —NH or —OH in which $M_7$ is synonym for M; provided that the groups represented by $B_{31}$ through $B_{35}$ are not all hydrogen atom.

Formula K-V

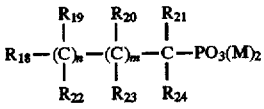

wherein $R_{18}$ through $R_{21}$ are each a hydrogen atom, —OH, a lower alkyl group which may have a substituent, the substituent includes —OH, —$COOM_{10}$, —$PO_3M_{11}$; $R_{22}$ through $R_{24}$ are each a hydrogen atom, —OH, —$COOM_{10}$, —$PO_3M_{11}$ or —$N(R')_2$; in the above, R' is a hydrogen atom, an alkyl group having 1 to 5 carbon atoms or —$PO_3M_{11}$; M, $M_{10}$ and $M_{11}$ are each a hydrogen atom or an alkali metal atom; and n and m are each 0 or 1.

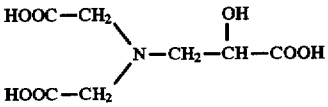

K-I-1

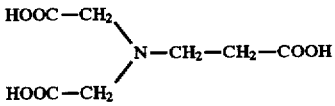

K-I-2

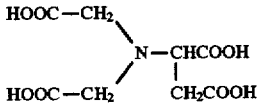

K-I-3

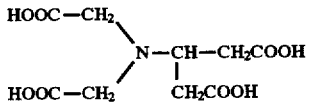

K-I-4

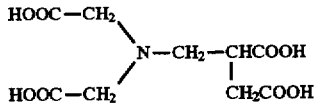

K-I-5

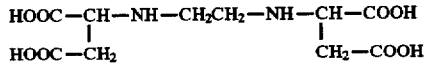

K-II-1

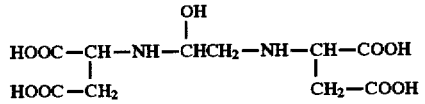

K-II-2

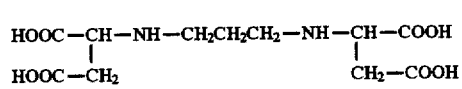

K-II-3

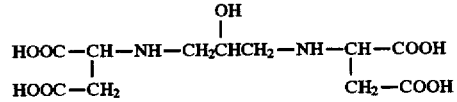

K-II-4

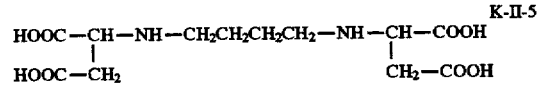

K-II-5

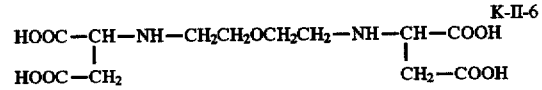

K-II-6

-continued

K-II-7

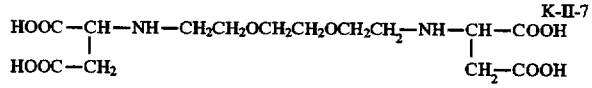

K-II-8

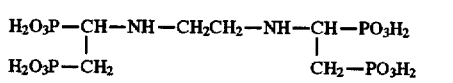

K-II-9

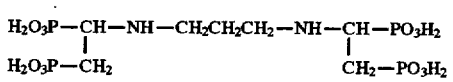

K-III-1

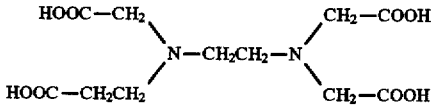

K-III-2

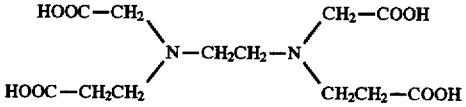

K-III-3

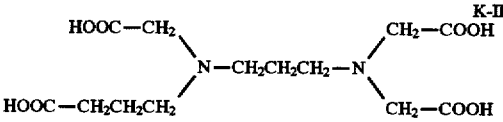

K-III-4

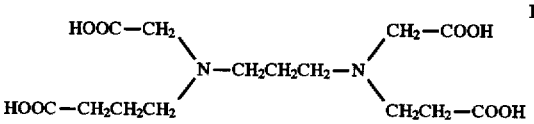

K-III-5

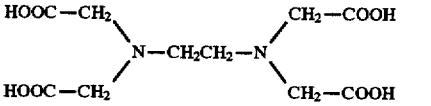

K-III-6

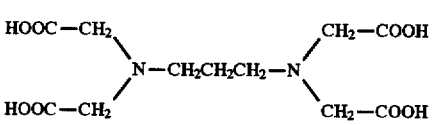

K-III-7

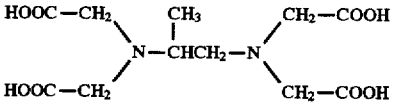

K-III-8

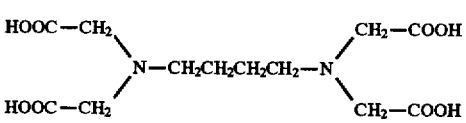

K-III-9

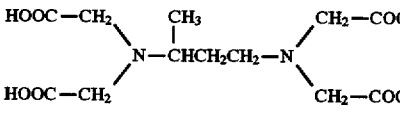

K-III-10

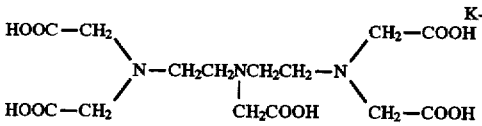

K-IV-1

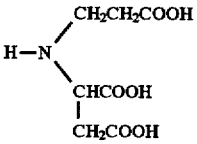

-continued

K-IV-2

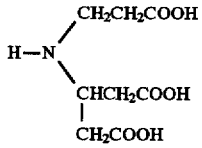

K-IV-3

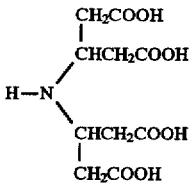

K-V-1

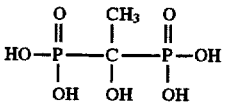

K-V-2

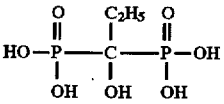

K-V-3

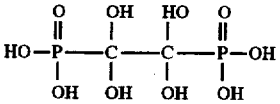

Among these kelating agent, K-I-2, K-II-1, K-II-5, K-III-10, K-IV-1 and K-V-1 are particularly preferred.

An anionic, cationic, amphoteric or nonionic surfactant may be contained in each of the processing solutions for color development in the invention, various kinds of surfactant such as alkylsulfonic acid, arylsulfonic acid, aliphatic carboxylic acid and aromatic carboxylic acid may also be added.

It is preferred that at least one of a first color developing partial solution containing a color developing agent as a principal component, a second color developing partial solution containing an alkaline agent as a principal component and a color developing solution to be used in the color developing process of the invention, contains a compound represented by the following Formula 1, 2, 3 or 4. The storage ability of the color developing agent is improved by addition of the compound and the processing can be carried out rapid Formula 1

Formula 2

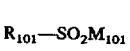

wherein $R_{101}$ is an alkyl group hhaving 1 to 6 carbon atoms, a cycloalkyl group, an aryl group, a heterocyclic group including one condensed with a 5- or 6-member unsaturated ring, a sulfonic acid group, a phosphoric acid group, a carboxyl group, an amino group, a hydroxyl group or a thiol group, the above groups each may have a substituent; $M_{101}$ is a hydrogen atom, an ammonium group or an alkali metal atom, Formula 3

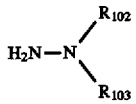

Formula 4

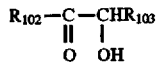

wherein $R_{102}$ and $R_{103}$ are each an alkyl group, an aryl group or a heterocyclic group including at condensed with a 5- or 6-member unsaturated ring, the above groups each may have a substituent and may be bonded with each other to form a ring.

Examples of preferably usable compound represented by the above formulas are shown below. However, the invention is not limited thereto.

$CH_3-CH_2-SH$ 1-1

$CH_3CH_2-SNH_4$ 1-2

$HOOC-CH_2-CH_2-SH$ 1-3

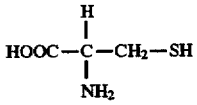
1-4

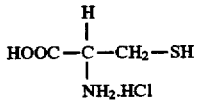
1-5

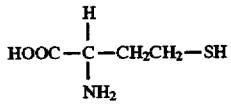
1-6

$HOOC-CH_2-SH$ 1-7

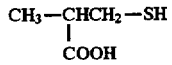
1-8

$H_2N-CH_2CH_2-SH$ 1-9

$H_2N-CH_2CH_2-SH.HCl$ 1-10

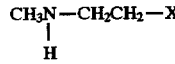
1-11

$(CH_3)_2N-CH_2CH_2-SH$ 1-12

$HO-CH_2CH_2-SH$ 1-13

$HS-CH_2CH_2-SH$ 1-14

$HO_3S-CH_2CH_2-SH$ 1-15

$HO_3P-CH_2CH_2-SH$ 1-16

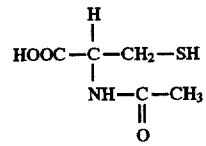
1-17

-continued

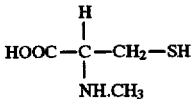
1-18

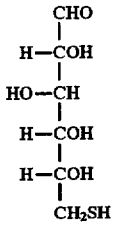
1-19

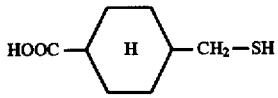
1-20

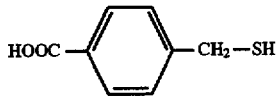
1.21

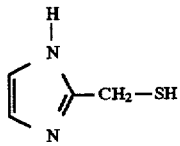
1-22

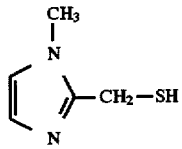
1-23

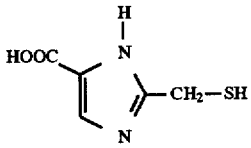
1-24

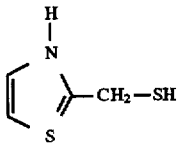
1-25

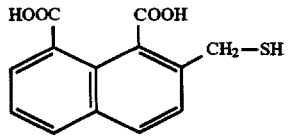
1-26

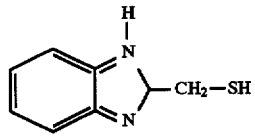
-27

$CH_3-SO_2H$ 2-1

$CH_3-SO_2NH_4$ 2-2

$HOOC-CH_2CH_2-SO_2H$ 2-3

-continued
2-4
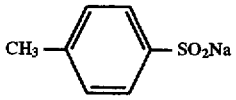
2-5
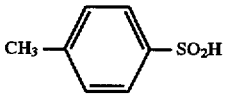
2-6
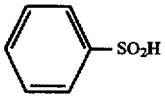
2-7
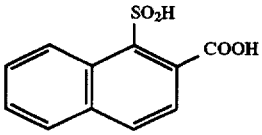
2-8
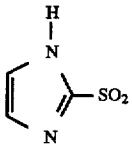
2-9
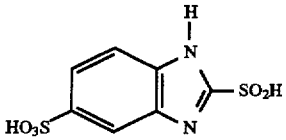
3-1
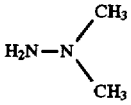
3-2
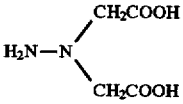
3-3
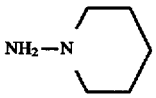
3-4
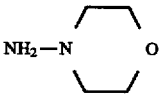
3-5
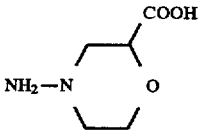
3-6
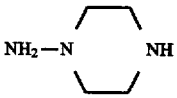
3-7
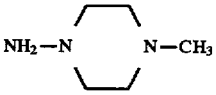
-continued
3-8
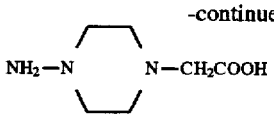
3-9
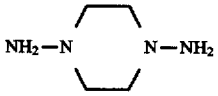
3-10
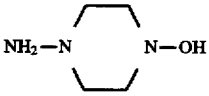
4-1
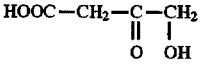
4-2
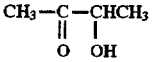
4-3
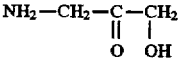
4-4
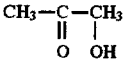
4-5
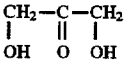
4-6
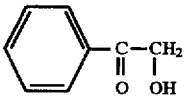
3-3
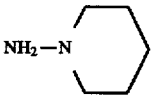
3-4
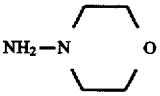
3-5
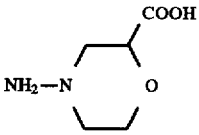
3-6
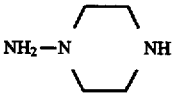
3-9
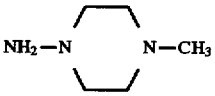
3-10
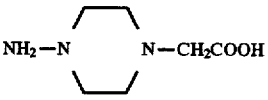
4-1
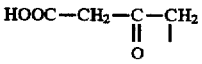
4-2
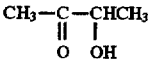

-continued 4-3 $NH_2-CH_2-C(=O)-CH_2-OH$ 4-4 $CH_3-C(=O)-CH_2-OH$ 4-5 $CH_2(OH)-C(=O)-CH_2-OH$ 4-6 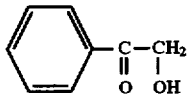

4-7 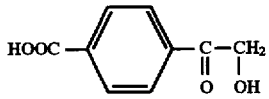

4-8 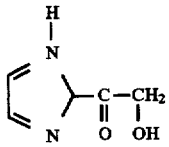

4-9 $CH_3-C(=O)-C(OH)-C(=O)-CH_3$

Among the above-mentioned compounds, 1-3, 1-4, 1-5, 1-9, 1-10, 1-17, 2-4, 3-4, 3-9, 4-4, and 4-5 are preferable and 1-4, 1-10, 2-4, 3-4 and 4-4 are particularly preferable.

The compound represented by Formula 1,2,3 or 4 is preferably used in an concentration of 0.0005 to 0.1 moles, more preferably 0.0008 to 0.05 moles, further preferably 0.004 to 0.02 moles per liter.

It is preferred that the compound is contained in the partial solution containing a color developing agent as a principal component. The compound represented by Formula 1 is preferably contained in the partial solution containing an alkaline agent as a principal component for enhancing the development accelerating effect of the compound.

The concentration of p-diphenylamine type color developing agent in the partial solution containing the developing agent as a principal component is usually 0.005 to 1.00 moles, preferably 0.01 to 0.25 moles, further preferably 0.06 to 0.13 moles, per liter. When the color developing agent is difficulty dissolved depending to the influence of the temperature or another solute, it is preferred to use the color developing agent within the range of dissolvable concentration. The concentration of the paraphenylenediamoine type developing agent in the color developing solution is preferably 0.005 to 0.03 moles per liter.

[Bleaching process]

It is preferred that the bleaching solution contains at least one kind of water containing ferric complex salt of aminopolycarboxylic acid. Two or more kinds of hydrated salt of ferric complex of aminopolycarboxylic acid, different from each other, may be used in combination.

It is preferred that the ferric complex salt of aminopolycarboxylic acid is used in the form of a ferric complex the following free aminopolycarboxylic acid. A compound represented by the following Formula I, and it is more preferable that the ferric complex is used with the aminopolycarboxylic acid in a form of free acid in combination. It is particularly preferred that the ferric complex salt is used in combination with the free aminopolycarboxylic acid the same as that constituting the ferric complex. The hydrated salt of ferric complex of aminopolycarboxylic acid can be used in a form of a salt of potassium, sodium or ammonium, and the free aminopolycarboxylic acid can also be used in a form of free acid or a salt of potassium or sodium.

Formula I

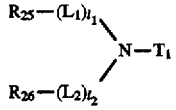

in the formula $T_1$ is a hydrogen atom, a hydroxy group, a carboxyl group, a sulfo group, a carbamoyl group, a phosphono group, a phosphon group, a sulfamoyl group, a substituted or unsubstituted alkyl group, an alkoxy group, an alkylsulfonamido group, an alkylthio group, an acylamino group or a hydroxamic acid group, a hydroxyalkyl group or

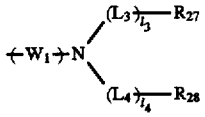

wherein $E_1$ is an alkylene, arylene, alkenylene, cycloalkylene or aralkylene group, they each may have a substituent, or $-(L_5-X)_{l_6}-(L_6)_{l_6}$ wherein X is —O—, —S—, a divalent

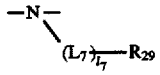

heterocyclic group or $R_{25}$ through $R_{29}$ are each independently a hydrogen atom, a hydroxyl group, a carboxyl group, a sulfo group, a carbamoyl group, a phosphono group, a phosphon group, a sulfamoyl group, a sulfonamido group, an acylamino group or a hydroxamic acid group, provided that at least one of $R_{25}$ through $R_{29}$ is a carboxyl group. $L_1$ through $L_7$ are each independently a substituted or unsubstituted alkylene, arylene, alkenylene, cycloalkylene or aralkylene group; and $l_1$ through $l_7$ independently represent an integer of 0 to 6, provided that $l_5$ through $l_6$ are not simultaneously 0.

Examples of the amino polycarboxylic acid represented by Formula I constituting the ferric complex of an amino polycarboxylic acid hydrate, exemplified compound Group-I, are shown below.

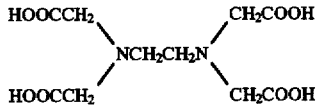

(I-1)

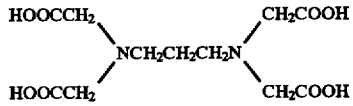

(I-2)

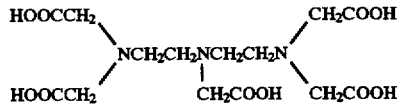

(I-3)

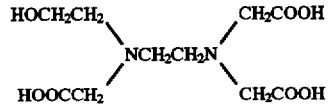

(I-4)

-continued
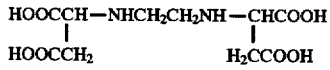
(I-5)
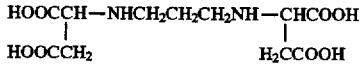
(I-6)
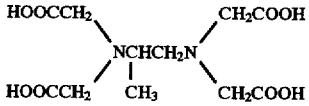
(I-7)
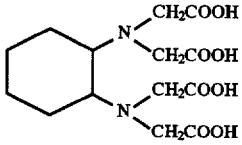
(I-8)
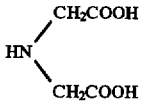
(I-9)
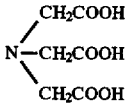
(I-10)
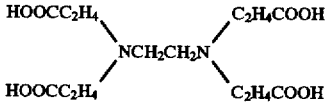
(I-11)
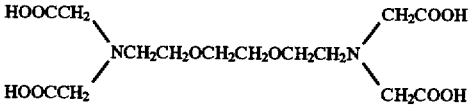
(I-12)
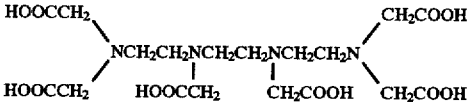
(I-13)
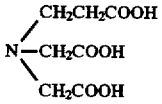
(I-14)
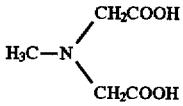
(I-15)
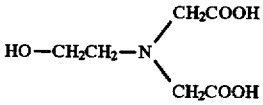
(I-16)
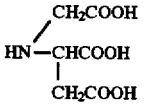
(I-17)
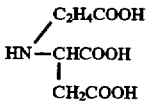
(I-18)
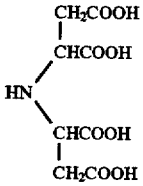
(I-19)
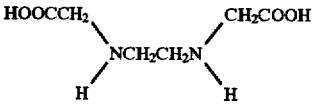
(I-20)
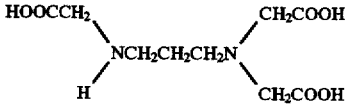
(I-21)
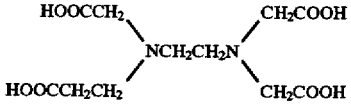
(I-22)
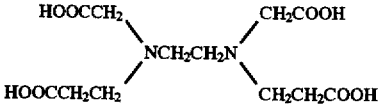
(I-23)
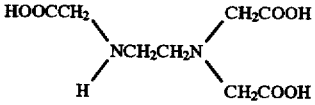
(I-24)
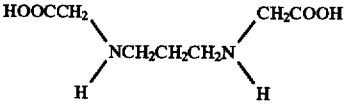
(I-25)
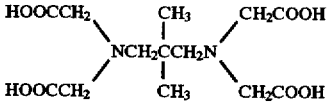
(I-26)
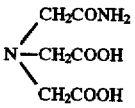
(I-27)
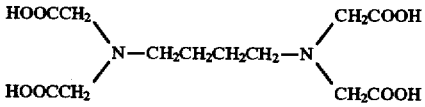
(I-28)
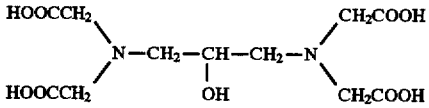
(I-29)
Among these compounds, (I-1) through (I-8), (I-12), (I-14) through (I-20), (I-22), (I-23) and (I-27) are preferable, and (I-1), (I-2), (I-6), (I-12), (I-14), (I-15) and (I-17) are especially preferable.
Examples of the ferric complex of an aminopolycarboxylic acid in the invention, exemplified compounds group-II, and the preferable crystal water content are shown below.

| Aminopolycarboxylic acid Fe(III) complex (Exemplified compound Group-II) | | | Preferable amount of crystal water of amino polycarboxylic acid Fe(III) complex |
|---|---|---|---|
| No. | Amino polycarboxylic acid (Exemplified Compound Group-I) | Cation | Mol of crystal water per mol of the complex |
| II-1 | I-1 | $Na^+$ | 3 |
| II-2 | I-1 | $K^+$ | 2 |
| II-3 | I-1 | $NH_4+$ | 2 |
| II-4 | I-2 | $Na^+$ | 3 |
| II-5 | I-2 | $K^+$ | 1 |
| II-6 | I-2 | $NH_4^+$ | 1 |
| II-7 | I-3 | $K^+$, $H^+$ | 1 |
| II-8 | I-3 | $NH_4^+$, $H^+$ | 1 |
| II-9 | I-5 | $K^+$ | 1 |
| II-10 | I-5 | $NH_4^+$ | 1 |
| II-11 | I-14 | — | 2 |
| II-12 | I-28 | $K^+$ | 1 |
| II-13 | I-26 | $K^+$ | 1 |
| II-14 | I-10 | — | 1.5 |
| II-15 | I-8 | $NH_4^+$ | 2 |

The bleaching solution preferably contains an organic acid compound represented by the following Formula A.

Formula A $$A'(—COOM)_n$$

in the formula, A' is an n-valent organic group; n represents an integer of 1 to 6; M is an ammonium group, an alkali metal such as sodium, potassium or lithium, or a hydrogen atom.

In Formula A, the n-valent organic group represented by A' includes an alkylene group such as methylene group, ethylene group, trimethylene group or tetramethylene group, an alkenylene group such as ethenylene group, an alkynylene group such as ethynylene group, a cycloalkylene group such as 1,4-cyclohexane-di-yl group, an arylene group such as o-phenylene group or p-phenylene group, an alkane-tri-yl group such as 1,2,3-propane-tri-yl group, and arene-tri-yl group such as 1,2,4-benzene-tri-yl.

The above-mentioned n-valent groups represented by A' include those having a substituent such a hydroxyl group, trimethylene group or tetramethylene group; examples of the group having such substituent include 1,2-dihydroxyethylene, hydroxyethylene, 2-hydroxy-1,2,3-propane-tri-yl, methyl-p-phenylene, 1-hydroxy-2-chloroethylene, cholormethylene and chloroethylene. preferable examples of the compound represented by Formula A are shown below.

$HOOCCH_2C(OH)(COOH)CH_2COOH$ (A-1)

$HOOC(CHOH)_2COOH$ (A-2)

$HOOCCH_2COOH$ (A-3)

$HOOCCH(OH)CH_2COOH$ (A-4)

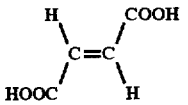
(A-5)

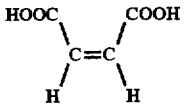
(A-6)

$(COOH)_2$ (A-7)

-continued

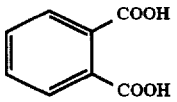
(A-8)

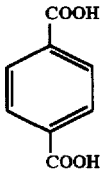
(A-9)

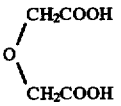
(A-10)

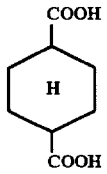
(A-11)

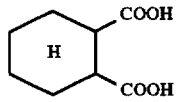
(A-12)

$HOOC-(CH_2)_3-COOH$ (A-13)

$HOOC-(CH_2)_4-COOH$ (A-14)

$HOOCC\equiv CCOOH$ (A-15)

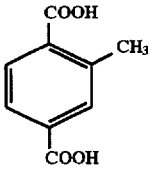
(A-16)

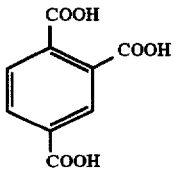
(A-17)

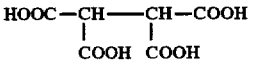
(A-18)

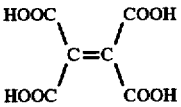
(A-19)

$HO-CH_2-COOH$ (A-20)

Among the above-mentioned compounds, (A-1), (A-3), (A-4), (A-5), (A-6), (A-13), (A-14), (A-15) and (A-20) are specifically preferred, and (A-1), (A-5), (A-6), (A-13) and (A-14) and (A-20) are particularly preferred. The salts of the above-mentioned acids include ammonium salt, lithium salt, sodium salt and potassium salt. Among them, sodium salts and potassium salts are preferred from the viewpoint of preservability. These organic acids and salts thereof ma be used singly or in combination of two or more kinds of them.

In the bleaching solution, a rehalogenation agent may be contained. As the rehalogenation agent, known ones can be used, for example, ammonium bromide, potassium bromide, sodium bromide, potassium chloride, sodium chloride, ammonium chloride, potassium iodide, sodium iodide and ammonium iodide. In the invention, for example, the bleaching process, bleach-fixing prcess and stabilizing process described in JP O.P.I. No. 8-201997/1996, p.p. 23–16, [0124]–[0133], p.p. 19–21, [0078]–[0102] and p.p. 21–22, [0104]–[0109], respectively, are preferably used.

EXAMPLES

The invention is described in detail according to examples below, the embodiment of the invention is not limited thereto

Example 1

Figure 2:
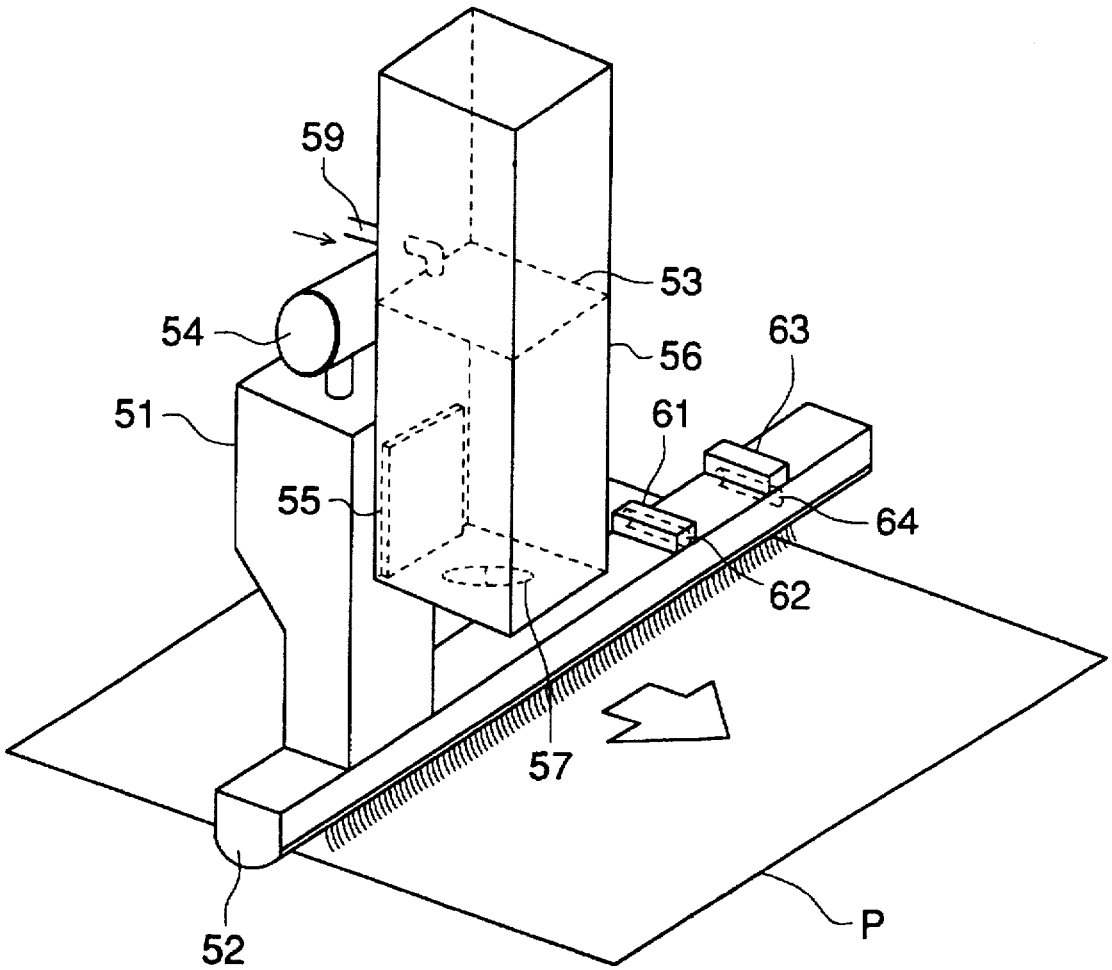
FIG. 2 is perspective view of the principal part of the automatic processor shown in FIG. 1.
Figure 3:
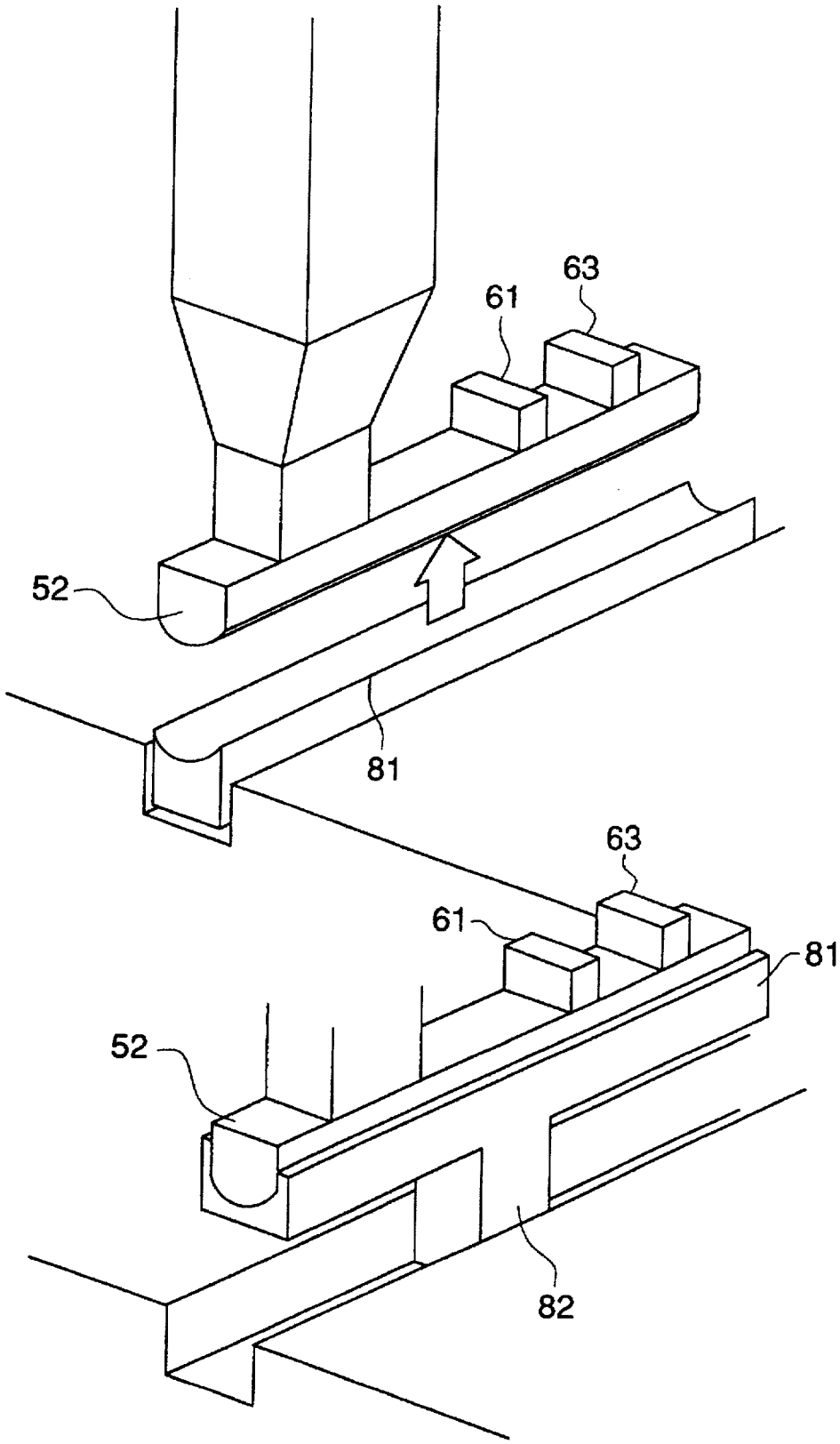
FIG. 3 is perspective view of a part near the means for preventing drying of the supplying pot of the automatic processor shown in FIG. 1

An outline of the constitution of principal part of an automatic processor used in the examples is described according to FIG. 1. FIG. 2 is a perspective view of the principal part of the automatic processor. FIG. 3 is perspective view of the portion near a drying preventing means of processing solution supplying port of the automatic processor.

The automatic processor has transporting rollers which are not shown in the drawing, a heating drum 11, a pressing belt 15, heating belt 33 and transporting rollers of the bleach-fixing bath and the bathes following the bleaching bath as the means for transporting the silver halide photographic light-sensitive material P. The processor further has a light sensitive material detecting means 70 for detecting the presence of the light-sensitive material P, at a position upper, in the transportation course of the light-sensitive material P than the position to which the processing solution is supplied from a processing solution supplying means 52. There is a heating means 10 for heating the light-sensitive material P at a position lower in the course of transportation of the light-sensitive material, than the light-sensitive material detecting means 70. The heating means 10 comprises a heating drum 11, and there is an outlet-roller 12 at a upper position of the heating drum. There is an inlet-roller 13 at left side position of the heating drum 11. Further, a driving roller 14 is positioned at left position of the outlet-roller 12 and an upper position of the inlet-roller 13. The pressing belt 15 is fitted through the inlet-roller 12, outlet-roller 13 and driving roller 14 so that the pressing belt is moved while pressing to the heating drum 11 in a range of 90° of the surface of the heating drum 11 to transport the light-sensitive material P while being pressed to the heating drum 11. The light-sensitive material is heated by the above-mentioned constitution.

A developing means 50 is provided at a position lower in the light-sensitive material transportation course, than the heating drum 11. The developing means comprises a first processing solution container and a second processing solution container each storing a processing solution for color development of the light-sensitive material P. The first and second containers are hermetically sealed to air. In this example, a supplying head later-mentioned is used as processing solution supplying means 52. The processing solution supplying means 52 supplies through space the processing solution for color development to the emulsion surface of the light-sensitive material P which is heated by the heating means 10. Further, a circulation pep 54 is provided at a position upper the first processing solution container 51 and left side of the second processing solution container 56, and a filter 55 is provided on a partition wall between the first processing solution container 51 and the second processing solution containers 56. The processing solution is circulated by driving the circulation pump 54 in the direction the arrow shown in the drawing through the first processing solution container 51, the circulation pump 54, the second processing solution container 56 and the filter 55 in this order. A stirrer 57 is rotated in the second processing solution container 56 for stirring the processing solution in the second processing solution container 56. Thus the filtering means, filter 55, provided between the second processing solution container 56 for filtering the processing solution coming from the second processing solution container 56 and the processing solution supplying means 52 are functioned.

Figure 4:
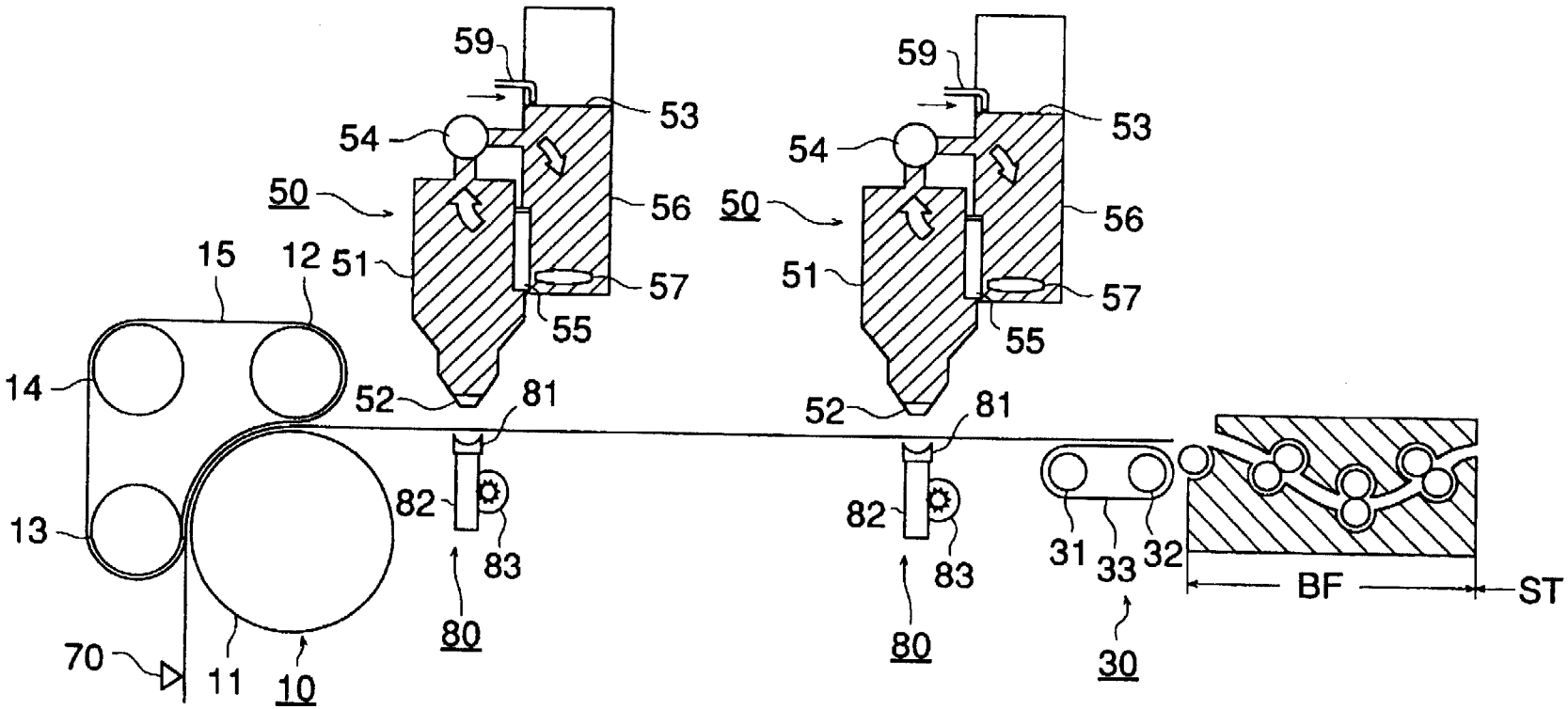
FIG. 4 is schematic drawing of the principal part of the automatic processor having two of the processing solution supplying means.

FIG. 4 is a schematic drawing showing the principal part of an automatic processor having two of the developing means 50. In this examples the processing using the processor shown in FIG. 1 and that shown FIG. 4 are each referred to Processing methods 1 and 2, respectively. Processing method 1 falls without in the scope of the invention because only one kind of developing solution is supplied to the light-sensitive material. Processing method 4 is a method according to the invention, in which two kinds of partial solutions are separately supplied to the light-sensitive material from each of the two processing means.

A replenishing solution is replenished to the second processing solution container 56 from a replenishing solution supplying means 59.

A first shutter 62 and a second shutter 64 are provided on the processing solution supplying means 52 to stop the processing solution on the half way of the supplying course of the processing solution in the width direction of the light-sensitive material for controlling the supplying width of the processing solution adjusting to the width of the surface of the light-sensitive material. The first shutter 62 is driven by a first shutter driving means 61 so as to be able to optionally inserting to and releasing from the supplying course of the processing solution. The second shutter 64 is driven by a second shutter driving means 63 so as to be able to optionally inserting to and releasing from the supplying course of the processing solution. FIG. 2 shows a situation in which the second shutter 64 is inserted in the processing solution supplying course to the processing solution supplying head.

A supplying port drying preventing means 80 is provided under the processing solution supplying means 52 to prevent drying the processing solution remaining at the supplying port of the supplying head of the processing solution supplying means 52 by covering the processing solution supplying port of the supplying head when the processing solution is not supplied to the light-sensitive material P. The supplying port drying preventing means 80 comprises a movable cover 81, a supporting rod 82 for supporting the movable cover 81, and a motor 83 to up and down the supporting rod 82. A rack and a pinion are each provided to the supporting rod 82 and the motor 83, respectively, and the supporting rod 82 is driven up and down by the motor 83. The movable cover 81 has a cross section of a concave form. The processing solution supplying means 52 supplies the processing solution at periodic intervals, as is mentioned later, in a waiting mode, at which the processing of the light-sensitive material is not performed. At this time, the movable cover 81 is slightly moved down to receive the processing solution supplied from the processing solution supplying means 52, and the solution is exhausted through a hole provided in the supporting rod 82 to prevent smudging around the apparatus.

A second heating means 30 for heating the light-sensitive material P is provided at a position lower in the transporting course of the light-sensitive material than the position at which the processing solution is supplied through the space. The second heating means comprises a heating roller 31, driving roller 32 and a heating belt 33. The heating belt 33 is fitted with the heating roller 31 and the driving roller 32. The heating roller 31 is provided at the position lower in the transporting course of the light-sensitive material than the position at which the processing solution is supplied through the space, and heats the heating belt 33. The driving roller provided at a position lower in the transporting course of the light-sensitive material than the position of the of the heating roller, drives the heating belt 33. Thus the heating belt heats the light-sensitive material P. Accordingly, the silver halide photographic light-sensitive material on the emulsion surface of which the processing is supplied from the processing solution supplying means 52 trough the space, is heated by the second heating means 30.

Then the light-sensitive material P color developed by the developing means 50 is bleach-fixed in a bleach-fixing bath BF and is stabilized in a stabilizing bath ST.

Figure 5:
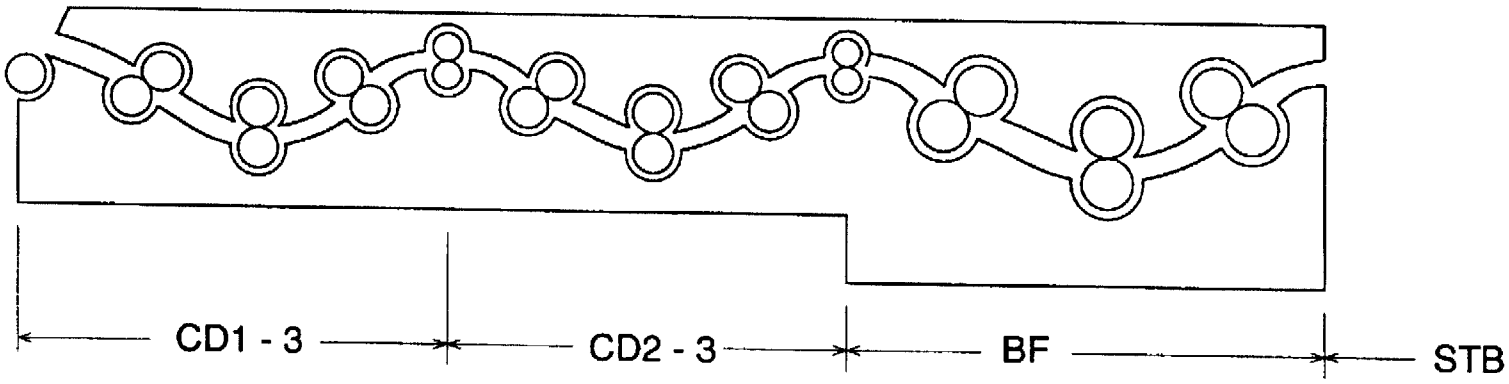
FIG. 5 is schematic drawing of the processing bath of an automatic processor for immersion development to which two kinds of processing solutions for color development can be supplied.

FIG. 5 shows a schematic drawing of a processing bathes of an automatic processor by immersion development, two kinds of processing solutions for color development can be supplied to the processor. The light-sensitive material P imagewise exposed is transported by a plurality of pairs of transporting rollers into developing bath CD1-3 and is treated therein. Then the light-sensitive material is transported through a color developing bath CD2-3, bleach-fixing bath BF and a stabilizing bath ST by roller transporting means in due order for processing. The processed light-sensitive material P is dried in a drying portion and discharged from the processor. The processing using this processor is referred to Processing method 3 falling without the invention.

Figure 6:
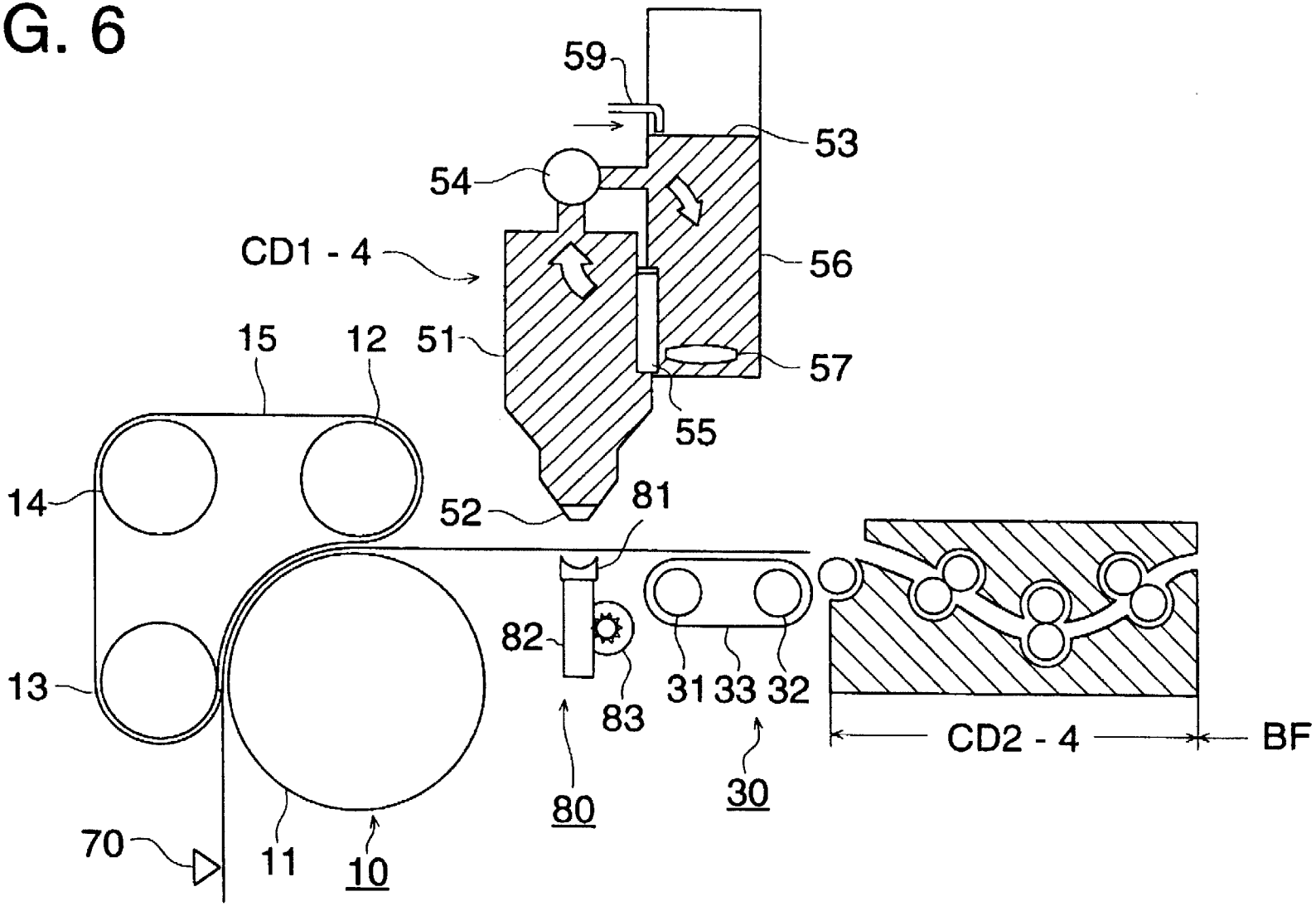
FIG. 6 is schematic drawing of an automatic processor in which one of processing solutions for color development is supplied through space and another is supplied by immersion.

FIG. 6 shows a schematic drawing of a type of automatic processor in which a partial solution of the processing solution for color development is supplied through space from processing solution supplying means CD1-4 to the light-sensitive material P and the light-sensitive material P is immersed in the processing solution in a processing bath CD2-4 to supply another partial solution thereto. After the color development, the light-sensitive material P is subjected to a bleach-fixing process and a stabilizing process and is exhausted from the processor. The processing using this processor is referred to Processing method 4.

[Heating condition]

The light-sensitive material P is heated the heating drum having a surface temperature of 70° C. so that the temperature of the emulsion surface of the light-sensitive material is raised to 50° C.

[Processing solution supplying means]

A linear-shaped supplying head is used in Processing methods 1, 2, and 4. The linear-shaped supplying head is provided so as to be perpendicular to the transporting direction of the light-sensitive material. The supplying ports are arranged in two staggered lines. The distance of the supplying ports is 100 μm in terms of the nearest edge distance. The diameter of the supplying port is 100 μm ($7.85\times10^{-9}$ $m^2$), the number of supplying times of the processing solution is 5000 times per second and the supplying amount of the processing solution is 50 ml in the Processing method 1 and 25 ml in the Processing methods 2 and 4 per square meter of the light-sensitive material to be processed.

[Light-sensitive material]

Konicolor QA Paper Type A6 color paper manufactured by Konica Corp. exposed by an ordinary method is processed.

[Processing solution: per liter]

<Color developing solution-1>

| | |
|---|---|
| Sodium sulfite | 0.2 g |
| Disodium bid(sulfoethyl)hydroxylamine | 12.0 g |
| Pentasodium diethylenetriaminepentaacetate | 3.0 g |
| Polyethylene glycol #4000 | 10.0 g |
| Potassium carbonate | 40.0 g |
| Sodium p-toluenesulfate | 10.0 g |
| 4-amino-3-methyl-N-ethyl-N-(β-methanesulfonamido)ethyl)aniline sulfate (CD-3) | 10.0 g |

Adjust pH value to 10.0 using potassium hydroxide or sulfric acid.

<Color developing solution-2>

Partial solution A containing a color developing agent as a principal component

| | |
|---|---|
| Sodium sulfite | 0.4 g |
| Pentasodium diethylenetriaminepentaacetate | 3.0 g |
| Polyethylene glycol #4000 | 10.0 g |
| Sodium p-toluenesulfate | 20.0 g |
| CD-3 | 50.0 g |

Adjust pH value to 1.5 using potassium hydroxide or sulfric acid.

Partial solution B containing an alkaline agent as a principal component

| | |
|---|---|
| Pentasodium diethylenetriaminepentaacetate | 3.0 g |
| Polyethylene glycol #4000 | 10.0 g |
| Potassium carbonate | 80.0 g |
| Potassium hydroxide | 10.0 g |

Adjust pH value to 13.0 using potassium hydroxide or sulfric acid.

<Bleach-fixing and stabilizing processes>

Processing is performed by means of the chemicals and conditions of CPK-2-J1 Process by Konica Corp.

The processing the color paper was continuously run for three weeks by each of the processors shown in FIG. 1, 4, 5 and 6, respectively. The processing amount of the color paper was 5 $m^2$ per day. In the Processing method 1, the color development was carried out by the Color developer-1 for 10 seconds. As the replenisher, the Color developer-1 was also used. In Processing method 2, the development was carried out using Color developer-2 for 10 seconds. For replenishing, Partial solutions A and B are also. The partial solutions were supplied in order of A and B with an interval of 1 second.

<Color developing condition in the processing method 3>

| Processing solution supplying means | Starting solution | Processing time (Sec.) | Temperature (°C.) | Amount ($ml/m^2$) |
|---|---|---|---|---|
| CD1-3 | Color developer-2 Partial solution A (pH 1.5) | 1 | 39.5 | 25 |
| CD2-3 | Color developer-2 Partial solution B (pH 13.0) | 9 | 39.5 | 25 |

In the above, the processing time is the duration from the time at which the light-sensitive material is immersed in the processing solution to the time at which the light-sensitive material is immersed in the next processing solution.

<Color developing condition in Processing method 4>

| Processing solution supplying means | Starting solution | Processing time (Sec.) | Temperature (°C.) | Amount (ml/m²) |
|---|---|---|---|---|
| CD1-4 | Color developer-2 Partial solution A (pH 1.5) | 1 | — | 25 |
| CD2-4 | Color developer-2 Partial solution B (pH 13.0) | 9 | 39.5 | 25 |

The light-sensitive material was immersed in the processing tank CD2-4, 1 second after supplying Partial solution A of Color developer-2 by processing solution supplying means CD1-4.

The following two kinds of combination of the solutions were applied to Processing methods 2 and 4.

(1) Partial solution A of Color developer-2→ Color developer-1

(2) Water→Color developer-1

The processing was carried out for 10 seconds as to all the above conditions. The solution used in the processing were used also as replenishing solutions.

The color paper wedgewise exposed was processed at the initial time and the finishing time of the continuous processing for 3 weeks, and the maximum density of the developed image $D_{max}$(Y) was measured by blue-light. In the example, the value of $D_{max}$(Y) of not more than 2.0 is insufficient in the image density.

On the other hand, Color developer-1 and Partial solution A of Color developer-2 were each stored in the processing solution container or the processing bath for 2 weeks at a room temperature, and the remaining ratio of the color developing agent was measured. Further, the status of the processing solution supplying means for the solution to be secondary supplied after continuous processing was observed and was evaluated according to the following norms.

A: No precipitation was observed.

B: A slight turbidity was observed, but the turbidity does not causes any problem.

C: Considerable precipitation of crystals was observed.

Further, the color contamination was evaluated in the following manner. A sample in which the green-sensitive layer was selectively exposed to light was processed and the reflection density measured by blue light D1 was measured at the area having the reflective density measured by green light was 1.5. On the other hand, a sample exposed in the same manner as in the above-mentioned sample was processed by chemicals and processing conditions according to CPK-2-J1 process of Konica Corp., and the blue reflective density D2 at the area having the green reflective density of 1.5. The color contamination according to the value of ΔD=D1−D2. A smaller values of ΔD corresponds to better results.

Thus obtained results are shown in Table 1. In the column of "Color developer" of table, "1st supplied" and "2nd supplied" means each the solutions supplied from the solution supplying means positioned at upper and lower course of the transporting direction of the light-sensitive material, respectively.

TABLE 1

| Experiment No. | Processing method | Color developer 1st supplied | Color developer 2nd supplied | $D_{max}$(Y) Before running | $D_{max}$(Y) After running | After storage: Remaining ratio* (%) | After storage: Situation in container or bath | ΔD | Note |
|---|---|---|---|---|---|---|---|---|---|
| 1-1 | 1 | 1 | — | 1.58 | 1.02 | 89 | B | 0.00 | Comp. |
| 1-2 | 2 | 2A | 2B | 2.25 | 2.22 | 94 | A | 0.00 | Inv. |
| 1-3 | 3 | 2A | 2B | 2.21 | 1.72 | 62 | C | 0.10 | Comp. |
| 1-4 | 4 | 2A | 2B | 2.22 | 2.05 | 94 | B | 0.03 | Inv. |
| 1-5 | 2 | 2A | 1 | 2.21 | 2.17 | 94(1) 89(2) | A | 0.01 | Inv. |
| 1-6 | 2 | Water | 1 | 1.42 | 1.31 | 89 | A | 0.00 | Comp. |
| 1-7 | 4 | 2A | 1 | 2.17 | 2.09 | 94(1) 85(2) | B | 0.01 | Inv. |
| 1-8 | 4 | Water | 1 | 1.39 | 1.03 | 85 | C | 0.06 | Comp. |

*Remaining ratio of color developing agent in Partial solution A of color developer-2 (1)) and that of Color developer-1 (2))

It is understood from the above results that a sufficient image density can be obtained even when the light-sensitive material is processed by the rapid processing by applying at least one of the partial solution containing a color developing agent as a principal component and the partial solution containing an alkaline agent as a principal component through space. A stabilized processing ability, an excellent preservability of the developing agent can be obtained by such the supplying method of the processing solutions. And the precipitation of crystals and the color contamination can also be inhibited. Further it is that the raising of the development ability and the inhibition of the precipitation is further enhanced when both of the first and the second supplying of the solutions are carried out through space.

Example 2

Experiments were performed according to the above-mentioned Experiment No. 1-2 except that the supplying interval of the two partial solutions are changed as shown in Table 2. $D_{max}$(Y) of the samples each processed at the initial and final time of running of the continuous processing were measured, and the situation of development uneveness were evaluated visually according to the following norm.

A: Any uneveness of development is not observed.

B: Uneveness of development is hardly observed by visual observation.

C: Uneveness of development is slightly observed which does not cause any practical problem.

D: Uneveness of development is apparently observed.

TABLE 2

| Exp. No. | Supplying Interval (sec.) | $D_{max}$ (Y) Initial time | $D_{max}$ (Y) Final time | Situation of development uneveness |
|---|---|---|---|---|
| 2-1 | 0.3 | 2.26 | 2.24 | A |
| 2-2 | 1 | 2.25 | 2.22 | A |
| 2-3 | 3 | 2.14 | 2.11 | B |
| 2-4 | 5 | 2.03 | 2.01 | C |
| 2-5 | 6 | 1.78 | 1.74 | D |

It is understood from the above that a rapid processing can be performed and the development uneveness can be inhibited when the interval of supplying the two processing solution is 5 seconds or less. It is clear that the effects of the invention is further enhanced when the interval is not more than 3 seconds, particularly not more than 1 second.

Example 3

Samples of the light-sensitive material were processed in the same manner as at initial time of the continuous running of processing in Experiment 2 of Example 1, except that the supplying amount of partial processing solution B was changed as shown in Table 3. The experiments carried out according to Processing method 2 by using the processor shown in FIG. 4. The maximum reflective density measured by blue light $D_{max}$(Y) of each of the processed samples was determined. Further, the sample was take out after passing the developing process and before immersion in the bleach-fixing bath to observe the situation of the overflow of the solution from the light-sensitive material and the situation of stain formed on the white background of the sample. The result of the observation was evaluated according to the following norm.

A: Overflow of the solution and staining of white background are not observed.

B: Piling up of the solution is slightly observed but no stain is formed.

C: Piling up of the solution is observed but overflow of the solution and stain are not observed and any problem in practical use is not caused.

D: Overflow of the solution and formation of stain are observed.

Thus obtained results are listed in Table 3.

TABLE 3

| Exp. No. | Supplying amount (ml/m²) Partial solution A | Partial solution B | Ratio of B/A | $D_{max}$(Y) | Overflow of solution | Note |
|---|---|---|---|---|---|---|
| 3-1 | 25 | 25 | 1 | 2.22 | A | Invention |
| 3-2 | 25 | 50 | 2 | 2.20 | A | Invention |
| 3-3 | 25 | 125 | 5 | 2.12 | A | Invention |
| 3-4 | 25 | 250 | 10 | 2.05 | B | Invention |
| 3-5 | 25 | 275 | 11 | 1.98 | C | Invention |

As is shown in Table 3, is understood that a satisfactory sensitivity density can be obtained and the overflow of the solution and the stain formation on the white background can be inhibited when the ratio of supplying amounts of the two processing solutions is within the range of from 0.1 to 10.

Example 4

Samples of the light-sensitive material were processed in the same manner as in the processing method 2 in Example 1 at the initial time of the continuous running of the processing in experiment 1-2 of Example 1 except that the concentration of the color developing agent in the partial solution A of the color developer-2 was changed as shown in Table 4. The maximum reflective density measured by blue light $D_{max}$(Y) of each of the processed samples was determined. Further the color contamination in the processed samples was evaluated in the same manner as in Example 1. Thus obtained results are shown in Table 4.

TABLE 4

| Eex. No. | Color developing agent concentration (moles/l) | $D_{max}$(Y) | ΔD | Note |
|---|---|---|---|---|
| 4-1 | 0.0046 | 2.03 | 0.00 | Inventive |
| 4-2 | 0.011 | 2.16 | 0.00 | Inventive |
| 4-3 | 0.092 | 2.25 | 0.00 | Inventive |
| 4-4 | 0.11 | 2.25 | 0.00 | Inventive |
| 4-5 | 0.23 | 2.13 | 0.00 | Inventive |
| 4-6 | 0.46 | 2.09 | 0.01 | Inventive |
| 4-7 | 0.92 | 2.01 | 0.01 | Inventive |
| 4-8 | 1.03 | 2.00 | 0.02 | Inventive |

It is obvious from the results shown in Table 4 that the sufficient image density can be obtained and the color contamination can be inhibited when the concentration of color developing agent is within the range of from 0.005 to 1.00 moles per liter.

Example 5

Wedgewise exposed samples of the light-sensitive material were processed by Processing method 2 under the condition the same as in Experiment 1-2 of Example 1 at the initial time of the running of the continuous processing except that the concentration of potassium carbonate in the partial solution B of the color developer-2 was changed as shown in Table 5. The maximum reflective density measured by blue light $D_{max}$(Y) of each of the processed samples was determined, and the color contamination in the processed samples was evaluated in the same manner as in Example 1. Further, situation of the processing solution supplying means for Partial solution B of Color developer-2 was observed and evaluated according to the following norm.

A: Blocking of the solution supplying means is not observed.

B: Blocking of the solution supplying means is slightly observed, but any problem in the practical use is not caused.

C: Considerable blocking of the solution supplying means is observed.

Thus obtained results are shown in Table 5.

TABLE 5

| Exp. No. | Concentration of potassium carbonate (moles/l) | $D_{max}$ (Y) | ΔD | Processing solution supplying means |
|---|---|---|---|---|
| 5-1 | 0.072 | 2.03 | 0.00 | A |
| 5-2 | 0.11 | 2.14 | 0.00 | A |
| 5-3 | 0.36 | 2.22 | 0.00 | A |
| 5-4 | 0.58 | 2.25 | 0.00 | A |
| 5-5 | 1.16 | 2.21 | 0.01 | A |

TABLE 5-continued

| Exp. No. | Concentration of potassium carbonate (moles/l) | $D_{max}$ (Y) | ΔD | Processing solution supplying means |
|---|---|---|---|---|
| 5-6 | 3.26 | 2.10 | 0.02 | B |
| 5-7 | 3.62 | 1.98 | 0.04 | B |

It is obvious from the results in Table 5 that the sufficient image density can be obtained without blocking of the solution supplying means and the color contamination can be inhibited when the concentration of potassium carbonate is within the range of from 0.1 to 3.5 moles per liter.

Example 6

Samples of the light-sensitive material were processed by Processing method 2 under the condition the same as in Experiment 1-2 of Example 1 at the initial time of the running of the continuous processing except that the time of the color development was changed as shown in Table 6. The maximum reflective density measured by blue light $D_{max}$(Y) of each of the processed samples was determined. Further the color contamination in the processed samples was evaluated in the same manner as in Example 1. Thus obtained results are shown in Table 6.

TABLE 6

| Experiment No. | Color developing time (sec.) | $D_{max}$(Y) | ΔD |
|---|---|---|---|
| 6-1 | 4 | 1.98 | 0.00 |
| 6-2 | 5 | 2.07 | 0.00 |
| 6-3 | 10 | 2.25 | 0.00 |
| 6-4 | 30 | 2.28 | 0.01 |
| 6-5 | 40 | 2.27 | 0.02 |
| 6-6 | 50 | 2.28 | 0.04 |

It is obvious from the results in Table 6 that the sufficient image density can be obtained and the color contamination can be inhibited, and the effect of the invention is sufficiently enhanced when the color developing time is 5 to 45 seconds.

Example 7

Samples of Partial solution A of Color developing solution 2 were each prepared in the same manner as in Example 1 except that the compound shown in the following Table 7 is used in place of sodium sulfite. The samples were each put in a container opening to air with a opening area ratio of 200 $cm^2$/liter, and stood at a room temperature for testing the storage ability of them. The remaining ratio of the color developing agent was determined after 3 days and 7 days of storage. Thus obtained results are listed in Table 7.

TABLE 7

| Exp. | Additive | | Remaining ratio of developing agent (%) | |
|---|---|---|---|---|
| No. | Compound | Amount (g/l) | After 3 days | After 7 days |
| 7-1 | None | — | 85 | 54 |
| 7-2 | Sodium sulfite | 0.5 | 93 | 83 |
| 7-3 | 1-4 | 0.5 | 99 | 98 |
| 7-4 | 1-10 | 0.5 | 98 | 96 |

TABLE 7-continued

| Exp. | Additive | | Remaining ratio of developing agent (%) | |
|---|---|---|---|---|
| No. | Compound | Amount (g/l) | After 3 days | After 7 days |
| 7-5 | 2-4 | 0.5 | 97 | 93 |
| 7-6 | 3-4 | 0.5 | 96 | 92 |
| 7-7 | 4-4 | 0.5 | 96 | 93 |
| 7-8 | 1-4/4-4 | 0.25/0.25 | 99 | 97 |

It is understood from the result in Table 7 that storage ability of the color developing agent is considerably improved and the effects of the invention are further enhanced by the addition of the compounds represented by Formula 1,2,3 or 4.

What is claimed is:

1. A method for processing a silver halide color photographic light-sensitive material comprising a color developing process which comprises the first step of supplying one of a first color developing partial solution containing a color developing agent as a principal component and a second color developing partial solution containing an alkaline agent as a principal component, substantially only to an image-forming surface of said light-sensitive material, the second step of supplying one of said first partial solution and said second partial solution other than that supplied at said first step or a color developing solution containing a color developing agent and an alkaline agent, to the image-forming surface of said light-sensitive material at the same time or just after said first step.

2. The method of claim 1, wherein the solution supply at said first step is carried out through space.

3. The method of claim 2, wherein the solution supply through space at said first step is carried out by a solution scattering means.

4. The method of claim 1, wherein the solution to be supplied at said first step is said first partial solution.

5. The method of claim 1, wherein both of said first partial solution and said second partial solution are each supplied through space.

6. The method of claim 1, wherein the supplying volume ratio of said first partial solution and said second partial solution is within the range of 0.1 to 10.

7. The method of claim 1, wherein the concentration of the color developing agent in said first partial solution is within the range of from 0.005 moles to 1.00 mol per liter.

8. The method of claim 1, wherein the concentration of the alkaline agent in said second partial solution is within the range of from 0.1 moles to 3.5 moles per liter.

9. The method of claim 1, wherein the time necessary for passing the light-sensitive material through the color developing process is 5 to 45 seconds.

10. The method of claim 1, wherein at least one of said first partial solution, said second partial solutions and said color developing solution to be supplied at said first or second step contains a compound represented by Formula 1, 2, 3 or 4;

$R_{101}$—$CH_2$—$SM_{101}$ Formula 1

$R_{101}$—$SO_2M_{101}$ Formula 2 wherein $R_{101}$ is an alkyl group having 1 to 6 carbon atoms, a cycloalkyl group, an aryl group, a heterocyclic group including one condensed with a 5- or 6-member unsaturated ring, a sulfonic acid group, a phosphoric acid group, a carboxyl group, an amino group, a hydroxyl group or a thiol group, the above groups each may have a substituent; $M_{101}$ is a hydrogen atom, an ammonium group or an alkali metal atom, Formula 3

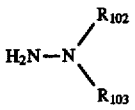

Formula 4

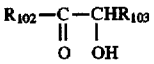

wherein $R_{102}$ and $R_{103}$ are each an alkyl group, an aryl group or a heterocyclic group including at condensed with a 5- or 6-member unsaturated ring, the above groups each may have a substituent and may be bonded with each other to form a ring.

* * * * *